US007679563B2

(12) United States Patent
Werner et al.

(10) Patent No.: US 7,679,563 B2
(45) Date of Patent: Mar. 16, 2010

(54) RECONFIGURABLE FREQUENCY SELECTIVE SURFACES FOR REMOTE SENSING OF CHEMICAL AND BIOLOGICAL AGENTS

(75) Inventors: Douglas H. Werner, State College, PA (US); Theresa S. Mayer, Port Matilda, PA (US); Jeremy A. Bossard, State College, PA (US); Robert P. Drupp, Columbia, MD (US); Xiaotao Liang, State College, PA (US); Ling Li, State College, PA (US)

(73) Assignee: The Penn State Research Foundation, University Park, PA (US)

( * ) Notice: Subject to any disclaimer, the term of this patent is extended or adjusted under 35 U.S.C. 154(b) by 815 days.

(21) Appl. No.: 10/586,117

(22) PCT Filed: Jan. 14, 2005

(86) PCT No.: PCT/US2005/001295

§ 371 (c)(1),
(2), (4) Date: Aug. 16, 2006

(87) PCT Pub. No.: WO2005/093904

PCT Pub. Date: Oct. 6, 2005

(65) Prior Publication Data

US 2008/0224947 A1 Sep. 18, 2008

Related U.S. Application Data

(60) Provisional application No. 60/536,444, filed on Jan. 14, 2004.

(51) Int. Cl.
*H01Q 1/38* (2006.01)
*H01Q 15/02* (2006.01)

(52) U.S. Cl. ..... 343/700 MS; 343/909

(58) Field of Classification Search ..... 343/700 MS, 343/755, 846, 848, 876, 909, 767
See application file for complete search history.

(56) References Cited

U.S. PATENT DOCUMENTS 5,571,401 A 11/1996 Lewis et al.

(Continued)

FOREIGN PATENT DOCUMENTS

WO WO-2006026741 A1 3/2006

(Continued)

OTHER PUBLICATIONS

L. Dai, P. Soundarrajan, and T. Kim. "Sensors and sensor arrays based on conjugated polymers and carbon nantubes". Pure Appl. Chem., vol. 74, No. 9, pp. 1753-1772, 2002.

(Continued)

*Primary Examiner*—Shih-Chao Chen
(74) *Attorney, Agent, or Firm*—Gifford, Krass, Sprinkle, Anderson & Citkowski, P.C.

(57) ABSTRACT

An improved frequency selective surface (FSS) comprises a periodically replicated unit cell, the unit cell including a material having a first electrical conductivity in the presence of an external condition, and a second electrical conductivity in the absence of an external condition, or in the presence of a modified external condition. For example, the material may be a chemoresistive material, having an electrical conductivity that changes in the presence of a chemical or biological analyte, i.e. having a first value of electrical conductivity in the presence of the analyte, and a second value of electrical conductivity in the absence of the analyte.

36 Claims, 16 Drawing Sheets

U.S. PATENT DOCUMENTS

| | | | | |
|---|---|---|---|---|
| 6,054,954 | A * | 4/2000 | Eggleston et al. | 343/700 MS |
| 6,323,309 | B1 | 11/2001 | Swager et al. | |
| 6,359,444 | B1 | 3/2002 | Grimes | |
| 6,525,695 | B2 * | 2/2003 | McKinzie, III | 343/756 |
| 6,558,626 | B1 | 5/2003 | Aker et al. | |
| 6,773,926 | B1 | 8/2004 | Freund et al. | |
| 6,777,228 | B2 | 8/2004 | Lejeune | |
| 2001/0038325 | A1 | 11/2001 | Smith et al. | |
| 2002/0167457 | A1 | 11/2002 | McKinzie et al. | |
| 2003/0034933 | A1 | 2/2003 | Frenkel | |
| 2003/0053935 | A1 | 3/2003 | Williams et al. | |
| 2003/0215865 | A1 | 11/2003 | Mayer et al. | |
| 2004/0121337 | A1 | 6/2004 | Deans et al. | |
| 2004/0129787 | A1 | 7/2004 | Saito et al. | |
| 2004/0263420 | A1 * | 12/2004 | Werner et al. | 343/909 |
| 2005/0072213 | A1 | 4/2005 | Besnard et al. | |
| 2006/0140240 | A1 | 6/2006 | Chen | |
| 2006/0255292 | A1 | 11/2006 | Ja | |
| 2007/0056392 | A1 | 3/2007 | Cumming et al. | |
| 2007/0111321 | A1 | 5/2007 | Deans et al. | |

FOREIGN PATENT DOCUMENTS

| | | | |
|---|---|---|---|
| WO | WO-2006026748 | A1 | 3/2006 |

OTHER PUBLICATIONS

D. Zhang, D.V. Plant, H.R. Fetterman, K. Chou, S. Prakash, C.V. Deshpandey, and R.F. Bunshah. "Optical control of millimeter wave high Tc superconducting quasi-optical band pass filters". Applied Physics Letters, American Institute of Physics. New York, vol. 58, No. 14. pp. 1560-1562. Apr. 8, 1991.

L. Lanuzza, A. Monorchio, D.J. Kern, and D.H. Werner. "A Robust GA-FSS Technique for the Synthesis of Optimal Multiband AMCs with Angular Stability". IEEE Antennas and Propagation Society International Symposium. 2003 Digest. Columbus, Ohio, Jun. 22-27, 2003: New York: IEEE, US, vol. 4 of 4, Jun. 22, 2003, pp. 419-422.

M.G. Bray, A. Kovalev, Z. Bayraktar, D.H. Werner, and T.S. Mayer, "Reconfigurable Dipole Chaff Elements for Passive Standoff Detection of Chemical Agents," Proceedings of the 2007 IEEE Antennas and Propagation Society International Symposium, Honolulu, Hawaii, USA, pp. 1513-1516, Jun. 10-15, 2007.

Liang, T., Li, L., Bossard, J.A., Werner, D.H., and Mayer, T. S., "Reconfigurable ultra-thin EBG absorbers using conducting polymers," Antennas and Propagation Society International Symposium, vol. 2B, pp. 204-207, Jul. 3-8, 2005.

Bossard, J.A., Werner, D.H., Mayer, T.S., Drupp, R.P., Reconfigurable infrared frequency selective surfaces, Antennas and Propagation Society International Symposium, Vol. 2, pp. 1911-1914, Jun. 20-25, 2004.

* cited by examiner

Switch sensitive to "A"

Switch sensitive to "B"

Switch sensitive to "C"

Switch sensitive to "D"

Fixed Metallic Cross-Dipoles

No Metal

RECONFIGURABLE FREQUENCY SELECTIVE SURFACES FOR REMOTE SENSING OF CHEMICAL AND BIOLOGICAL AGENTS

REFERENCE TO RELATED APPLICATION

This application claims priority to U.S. Provisional Patent Application Ser. No. 60/536,444, filed Jan. 14, 2004, the entire content of which is incorporated herein by reference.

GOVERNMENT SPONSORSHIP

This work was supported by the National Science Foundation under Grant No. DMR 0213623, and under DARPA grant HR0011-05-C-0015. Accordingly, the United States Government may have certain rights in this invention.

FIELD OF THE INVENTION

The present invention relates to apparatus, such as frequency selective surfaces, responsive to an external condition such as the presence of a chemical or biological analyte, and methods for detecting external conditions using such apparatus.

BACKGROUND OF THE INVENTION

A typical conventional Frequency Selective Surface (FSS) has a periodically replicated patterned metal film printed on the surface of a thin dielectric substrate material. A single instance of the replicated metal pattern is referred to as a unit cell. The unit cell may include one or more metal patches. The geometry of the metal patches is chosen to obtain a desired property of the FSS, such as electromagnetic scattering or absorption.

FSS applications include electromagnetic filtering devices for reflector antenna systems, radomes, absorbers, and artificial electromagnetic bandgap materials. The majority of FSS designs have been considered for microwave and millimeter wave applications, however the concept is scalable to higher frequency ranges such as infrared and even optical frequencies. FIGS. 20A-20C show three conventional devices, namely electromagnetic reflector 300, electromagnetic absorber 308, and antenna 310 respectively), each including a conventional FSS, the antenna also including radiative element 314. FIG. 20A shows absorber 300 comprising FSS 302, dielectric layer 304, and ground plane 306.

An electromagnetic absorber can be made by placing an FSS screen above a conventional metallic ground plane, separated by a relatively thin (compared to electromagnetic wavelength) dielectric layer. Such an FSS-based electromagnetic band gap (EBG) structure can act as an Artificial Magnetic Conductor (AMC) at a desired operating frequency, allowing thin absorbers (typical thicknesses can range from a tenth of a wavelength to as thin as a fiftieth of a wavelength or even less).

In a conventional absorber design, and in most FSS applications, the geometry and material parameters are engineered to produce a static frequency response. However, several groups have investigated the possibility of tuning or reconfiguring an FSS so that its frequency response can be shifted or altered altogether while in operation. This can be accomplished either by changing the electromagnetic properties of the FSS screen or substrate, by altering the geometry of the structure, or by introducing elements into the FSS screen that vary the current flow between metallic patches.

In a first class of Reconfigurable Frequency Selective Surface (RFSS), the frequency response of the FSS is changed by altering the electromagnetic properties of the substrate. Several groups have realized this by using a ferrite as the substrate material. By changing a DC bias applied across the ferrite substrate, the FSS can be tuned to higher or lower frequencies. However, there are some serious disadvantages associated with the concept of using ferromagnetic substrates. Ferrites have high mass, and large currents are required to maintain the DC bias across the substrate. Furthermore, setting up a DC bias over a large area of substrate is a complicated task. Nevertheless, a two-layer FSS with one or two ferrite substrates can be designed to switch between an absorber and a reflector at resonance by applying a DC bias to the substrate.

A related technique uses a liquid dielectric as the substrate. In this approach, a substrate cavity below the metallic screen is filled with a liquid dielectric or emptied to vary the permittivity. Varying the permittivity also varies the electrical wavelength inside the substrate, changing the frequency response. This technique has been demonstrated to tune the FSS frequency response, but it requires a complex design to properly handle the liquid substrate.

Another technique that alters the substrate properties uses a slotted FSS screen with a silicon substrate to produce a pass band at resonance under normal operation. However, when the silicon substrate is illuminated by an optical source with sufficient intensity, the silicon behaves like a conductor, making the pass band disappear. One final technique of interest involves using plasma to form a virtual FSS screen. Elements with a high plasma density behave like a metallic conductor. The plasma features can be altered thereby changing the frequency response of the virtual FSS.

The second category of RFSS design techniques are those in which the geometry of the metallic screen elements is altered in such a way as to effect a desired change in the frequency response. One technique that has been reported involves using two FSS screens with identical apertures or patch elements and a dielectric or spacing layer in between. The front and back screens are shifted vertically or horizontally with respect to each other, which produces a corresponding change in the frequency spectrum. The bandwidth and resonance positions both change when the screens are displaced.

A second reconfiguration technique has been introduced that is based on micro-electromechanical systems (MEMS) technology. The metallic elements of the FSS are designed to be able to lay flat on the substrate or tilt up to 90° from the substrate. Thus the incident radiation sees a variable-size element depending on the tilt angle of the metallic patches. This method for tuning the response of an FSS has been successfully demonstrated by Gianvittorio et al. (*IEE Electronics Letters*, Vol. 38, No. 25, December 2002). However, it requires complex fabrication techniques and the ability to produce an external electromagnetic field in order to mechanically control the element positions.

A further class of RFSS incorporates circuit elements into the metallic screen that can be used to vary the current between patch elements. A technique has been proposed for controlling the response of an FSS by interconnecting metallic patches in its screen with lumped variable reactive elements (C. Mias, *IEE Electronics Letters*, Vol. 39, No. 9, May 2003). Although variable reactive elements were not used in experiment, the effect of varying reactive loads between patches was shown through numerical simulations to shift the position of stop bands. This technique was taken a step further by including varactor diodes to tune the stop band of an FSS absorber.

Another option that has been investigated is to use PIN diodes as switches between metallic patch elements. PIN diodes either allow or inhibit current flow between patch elements depending on the voltage bias applied across the diode. Thus, they can be used to make a resonance disappear, or they can drastically change a resonance location based on the RFSS design. The active FSS described by Chang, et al. also incorporates a ferrite substrate so that the resonant frequency may be tuned by biasing the ferrite substrate or by switching the PIN diodes to go from a transmitting to a reflecting mode and back again (*IEEE Proc. Microwaves, Antennas and Propagation*, Vol. 143, No. 1, February 1996). One difficulty with using PIN diodes as switches in RFSS is the added complexity of incorporating bias lines into the design.

Several interesting applications have been suggested for RFSS that switch on or off using diodes. The design procedure for a horn antenna that has two tapered walls was described by Philips, et al. (*IEE Electronics Letters*, Vol. 31, No. 1, January 1995). The outer wall of the antenna is made of a solid metallic sheet while the second, narrower wall consists of a RFSS that incorporates diodes so that it can be switched from transmitting to reflecting. In the transmitting state, the horn antenna has a relatively wide aperture, but when the RFSS is switched to a reflecting state it acts as the inner wall of the horn antenna giving it a narrower aperture. The same type of active RFSS was proposed for building walls in order to control the transparency of the structure at a given radio frequency.

SUMMARY OF THE INVENTION

A frequency selective surface (FSS) comprises a periodically replicated unit cell, the unit cell including a material having a first electrical conductivity in the presence of an external condition, and a second electrical conductivity in the absence of an external condition, or in the presence of a modified external condition. For example, the material may be a chemoresistive material, having an electrical conductivity that changes in the presence of an analyte. The analyte may be a chemical or biological analyte.

The electrical conductivity may be correlated with the magnitude of an external condition, such as analyte concentration, electromagnetic radiation level, temperature, and the like. For example, the electrical conductivity may change substantially at a threshold magnitude of the external condition.

An example unit cell further comprises an arrangement of conducting patches on a dielectric substrate, for example in which at least two conducting patches are interconnected by the chemoresistive material. The unit cell can comprise a pattern of chemoresistive material and, optionally, conducting patches, on a substrate, such as a deictic material substrate. A unit cell can include one or more dielectric slots formed in a conducting medium, such as a metallic screen, and a chemoresistive material adjacent to the dielectric slot.

Example chemoresistive materials include conducting polymers having an electrical conductivity modified by the presence of an analyte, for example decreasing when the conducting polymer is exposed to the analyte. Other example chemoresistive materials include nanostructured semiconductors, other nanostructured conductors such as metals, chemical field effect transistors, composites of a polymer and electrically conducting particles (such as polymers which swell in the presence of an analyte, and carbon-containing particles).

An FSS according to the present invention may be used in an artificial magnetic conductor, electromagnetic absorber, electromagnetic reflector, electromagnetic scatterer, electromagnetic transmitter, antenna, or other device.

Examples of the present invention include a passive Reconfigurable Frequency Selective Surface (RFSS) comprising a periodic array of unit cells. In one example, each unit cell includes one or more metallic patches and one or more elements having an electrical conductivity correlated with an external condition such as the presence of light or an analyte (chemical and/or biological). Elements can be switches, such as switches formed from a chemoresistive material that changes electrical conductivity in the presence of an analyte. The unit cell configuration can be optimized, for example using a genetic algorithm or a particle swarm technique, for a desired frequency response.

Once optimal switch configurations have been determined, they can be conveniently stored in a look-up table for later use. A simple set of patches interconnected with chemoresistive switches can be tailored to meet a wide variety of frequency response requirements.

In other examples, a frequency selective surface is formed using a unit cell comprising a patterned chemoresistive material. The electromagnetic properties of the FSS are correlated with the conductivity of the chemoresistive material, and hence can be correlated with the presence of an analyte which modifies the conductivity of the chemoresistive material.

In other examples, a unit cell includes one or more slots cut in a conducting plane, and further includes a material with conductivity correlated with an external condition such as the presence of an analyte.

Switch materials sensitive to chemical or biological analytes can also be used in conjunction with antenna elements (such as ribbon dipoles) to change the transmit or receive properties of the antenna when the analyte is present.

An improved method of detecting an analyte comprises providing a structure (such as an FSS) having a chemoresistive material, the chemoresistive material having an electrical conductivity that changes on exposure to the analyte, and determining an electromagnetic property of the structure. The electromagnetic property changes in response to changes in the electrical conductivity of the chemoresistive material, allowing the determined electromagnetic property to be used to detect the analyte. The electromagnetic property can be electromagnetic transmission, electromagnetic absorption, or electromagnetic reflection, for example at a resonance frequency of an FSS, or a spectrum or spectra. The structure can be interrogated remotely using electromagnetic radiation from a remote source, such as a radar transmitter.

An improved apparatus includes a frequency selective surface (FSS), the FSS comprising a pattern of conductive patches, interconnected by a matrix of independently addressable switches. The switches can be passive switches, in that they need not be in electrical communication with an electrical power source, such as a voltage source. The apparatus may comprise a plurality of switch types, each switch type responsive to a different external condition, such as the presence or absence of different analytes.

DETAILED DESCRIPTION OF THE INVENTION

Figure 1:
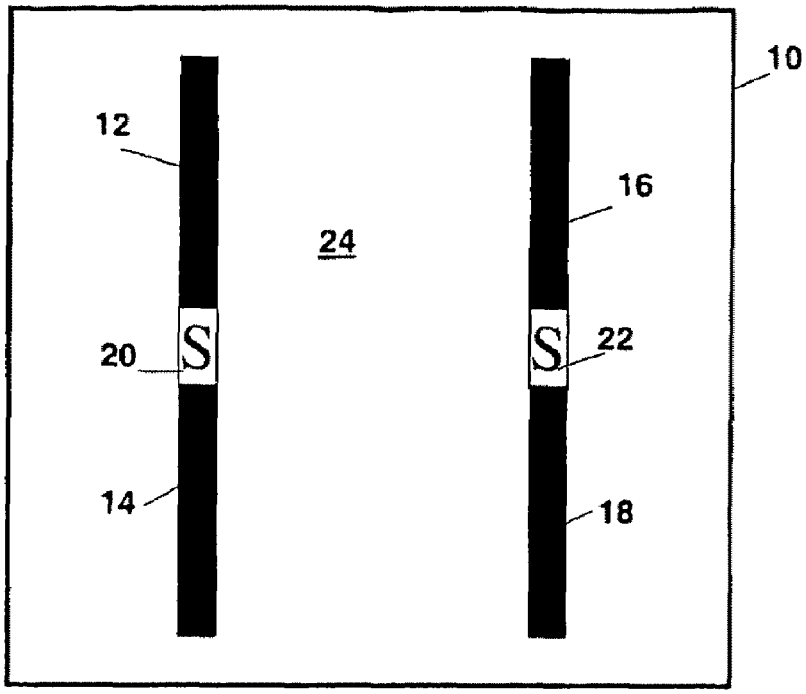
FIG. 1 shows a reconfigurable FSS unit cell geometry with two configurations.

Examples of an improved passive Frequency Selective Surface (FSS) comprise a periodic array of arbitrarily shaped metallic elements interconnected by a matrix of switches, where each switch or switch type can be independently addressed by applying external stimuli (light, chemical or biological analyte, etc.).

In one approach, an FSS comprises of a periodic array of metallic structures interconnected by switches, which may be turned on or off to modify the electromagnetic response of the FSS, or any device including the FSS.

An example FSS comprises metal patches and switches. The term FSS screen is conventionally used to refer to a pattern of metal patches, and here can be used to refer to a pattern of chemoresistive materials and/or other conductive materials, for example supported on a substrate. When the switches change state from off to on (or vice-versa) due to an external condition, this modifies the geometry of the conducting screen, for example by interconnecting metal patches. Another example FSS comprises of periodic dipole slots cut in a metallic screen with switches adjacent to one or both ends of the slots. If the switch is non-conducting, the slot length is effectively lower than if the switch is conducting. The switch or switches could also be placed at any location along the slot. An FSS having a changeable geometry of conducting and non-conducting regions is sometimes called a reconfigurable FSS, or RFSS. The term RFSS can be applied to examples of the present invention, referring to changing electromagnetic properties of the FSS.

In another approach, an FSS is used in a thin electromagnetic absorber in which the amount of loss can be controlled by the change in conductivity of the material (such as a polymer), or materials, used to make the FSS screen. For example, the FSS screen can be fabricated from a material having one or more electromagnetic properties (such as conductivity) correlated with an external condition. Examples include conducting polymers, which are good candidate materials for a lossy FSS screen in an absorber. It can be shown that a thicker screen requires a smaller conductivity change (for a given electromagnetic response to an external condition) than does a thinner one.

In the examples below, the term switch is used to describe an element having low electrical resistance when on, and high electrical resistance when off. In an idealized model, a switch has no resistance when on, and infinite resistance when off. However, examples of the present invention also include configurations including elements that change electrical resistance in the presence of an analyte, or otherwise in response to an external condition. The change in electrical resistance can modify the electromagnetic properties of the FSS, allowing the analyte to be detected. In this specification, the term analyte includes both chemical and biological analytes. The term "switch" is used generally to refer to a material that changes one or more electrical parameters (such as electrical conductivity) in response to a change in an external condition (such as the presence of an analyte).

The geometry of a passive frequency selective surface (FSS) screen can be altered by reconfiguring a matrix of switches (i.e., configuring switches on or off) such that different switch states result in a distinct electromagnetic response, such as a reflection, absorption, or transmission response. A RFSS can be designed to produce changes in the frequency and/or polarization response of the reflected or transmitted spectra of the surface in response to some external stimulus, such as the presence of an analyte. Thus, the reconfiguration results in a change in the electromagnetic properties or signature of the FSS, which can be interrogated and detected remotely using sources and detectors that are sensitive in the frequency range of interest. Such an RFSS has applications in diverse fields such as reconfigurable electromagnetic shielding, and remote chemical and biological sensing.

A reconfiguration of an FSS may comprise the operation of an electrical switch, triggered by the presence of an external stimulus, such as the presence of an analyte. A reconfiguration can also be a change in the electrical properties of one or more elements of an FSS due to the external stimulus.

The term FSS and RFSS are sometimes used interchangeably in this specification, for example to refer to an FSS having an electromagnetic response that is correlated with an external condition, such as the presence of an analyte. A change in electromagnetic response may arise from a portion of the unit cell becoming electrically conducting in the presence of an analyte, and from changes in electrical conductivity within a region of a unit cell.

An example frequency selective surface (FSS) includes a unit cell that is periodically replicated on a surface of a thin dielectric substrate material. In this context, the term "thin" relates to the substrate thickness being substantially less than the wavelength of electromagnetic radiation of interest. The geometry of the unit cell is the arrangement of conductive elements on the surface of the substrate. The geometry can be designed to transmit or reflect certain frequency bands. A reconfigurable FSS can be obtained by providing a unit cell having a fixed pattern of electrical conductor (such as an arrangement of metal patches) and further providing elements having an electrical resistance correlated with the presence of an analyte. For example, switches can be provided connecting fixed metal patches which may be turned on or off to achieve a desired frequency response. In other examples, the unit cell includes regions that change electrical resistance in a manner correlated with the presence or otherwise of an external condition, such as the presence of an analyte.

Hence, an example FSS according to the present invention has a first electromagnetic response in the absence of an external condition, and a second electromagnetic response in the presence of the external condition. The external condition can be the presence of a chemical or biological analyte. Hence, the analyte can be detected by the change from a first electromagnetic response to a second electromagnetic response. This change can be detected, for example, in the change in reflection, transmission, or absorption properties of the FSS. The FSS can be passive, in that no power source is required for the FSS. The electromagnetic response of the FSS can be monitored, for example, from reflection of electromagnetic radiation incident on the FSS. The electromagnetic properties of the FSS can be monitored remotely. The FSS may also be part of an antenna, or other device, the transmission or other property of which is modified by the external condition, such as presence of the analyte.

A substrate for an FSS typically comprises a thin dielectric sheet. This may be a flexible plastic, allowing the FSS to conform to the outer surface of an object, such as a vehicle or person. This thin dielectric sheet may or may not include a metallic backing.

FIG. 1 shows a unit cell geometry of an example reconfigurable FSS, where switch elements connect a subset of fixed metallic dipoles.

The figure shows a unit cell comprising metal patches (or fixed metallic dipoles) 12, 14, 16, 18, a first switch 20 located between metal patches 12 and 14, and a second switch 22 located between metal patches 16 and 18, the location of the switches being labeled "S". The white area 24 represents regions having no metal. When the switches are on, an electrically conducting link connects pairs of metal patches, so that the unit cell consists of two long dipoles. In contrast, when the switches are off, the unit cell comprises four shorter dipoles provided by the individual metal patches. The outer periphery 10 of the unit cell is shown by a square, though this does not correspond to a real physical structure. A FSS comprises a plurality of such unit cells repeated at regular intervals in one or (more commonly) two dimensions.

Figure 2A:
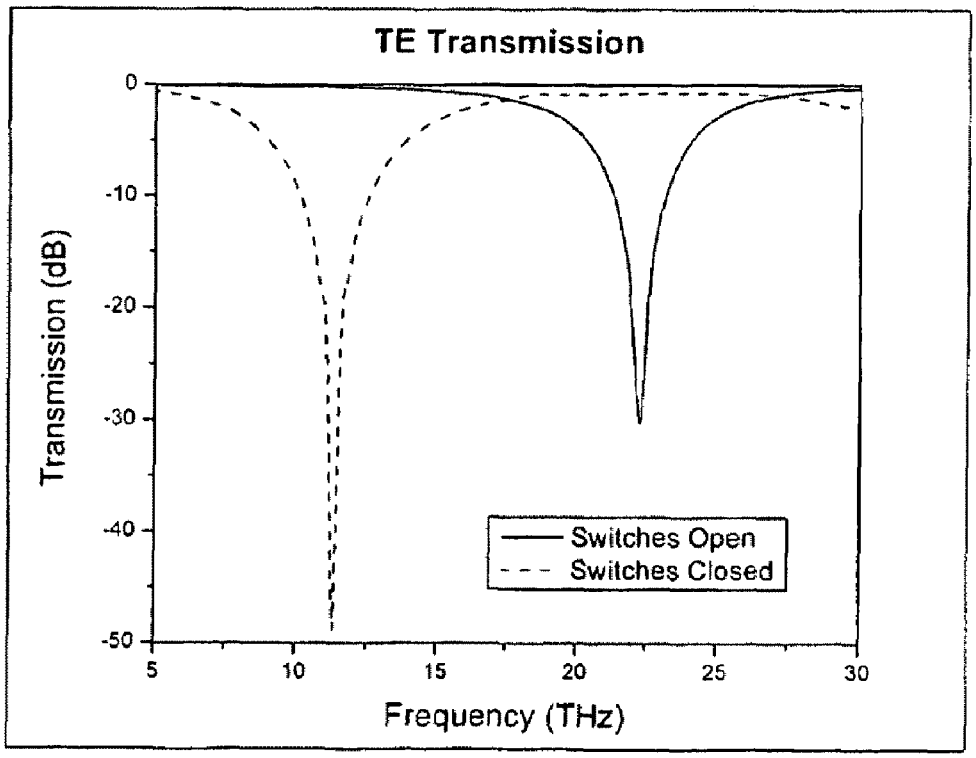
FIGS. 2A and 2B show transmission and reflection spectra (respectively) for the geometry of FIG. 1.
Figure 2B:
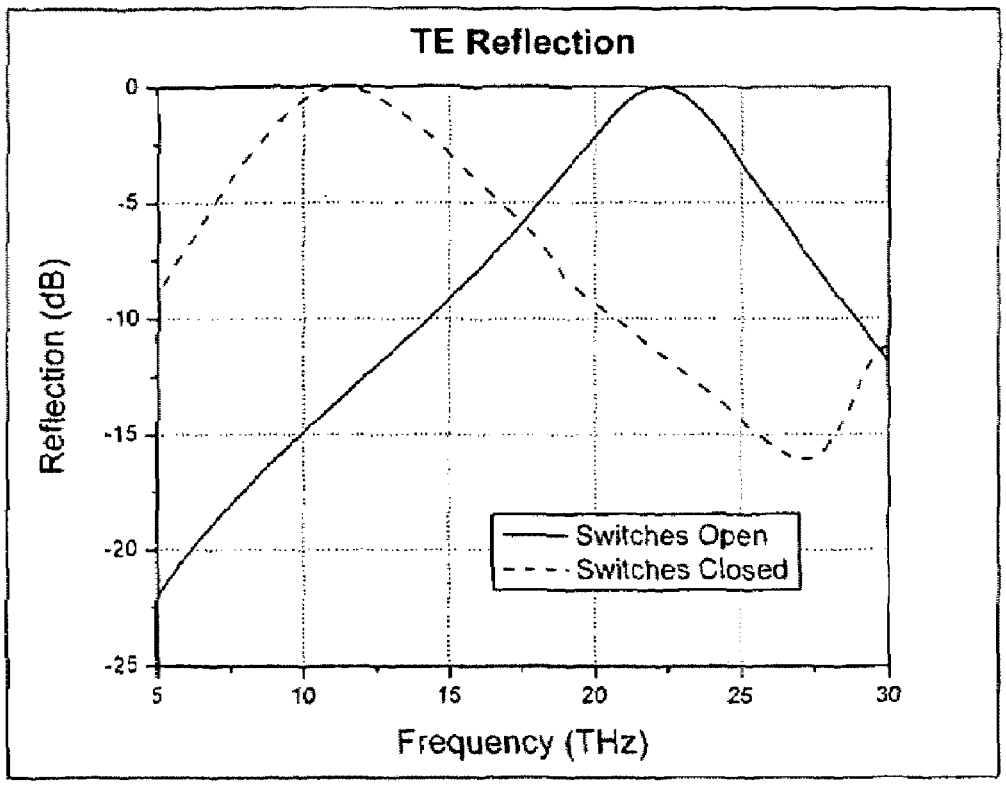

FIGS. 2A and 2B show the resulting transmission and reflection spectra (respectively) for a FSS having the unit cell geometry of FIG. 1, where the switches are both on or both off. It is evident from these spectra that the frequency at which the single transmission and reflection pass-band is observed can be changed by turning on the switches, and hence changing the effective dimensions of the overall dipole element (i.e., fixed metal plus switch).

The absolute pass-band frequencies and the difference in on and off pass-band frequency can be easily tailored by adjusting the relative dimensions of the fixed metal dipole and connecting switch elements. For instance, the FSS can be configured for a frequency response to a linearly polarized incident plane wave. In addition, the FSS designs of the present invention can be scaled to produce surfaces with a response at frequencies in the microwave, millimeter wave, infrared, and visible due to the inherent scalability of the electromagnetic theory used in their design.

In another embodiment of the invention, the FSS incorporates a multitude of different switches that can be turned on and off either individually or in groups. The unit cell geometry including switch states of an FSS can be optimized using a genetic algorithm to provide two or more stop bands at predetermined frequencies.

Figure 3:
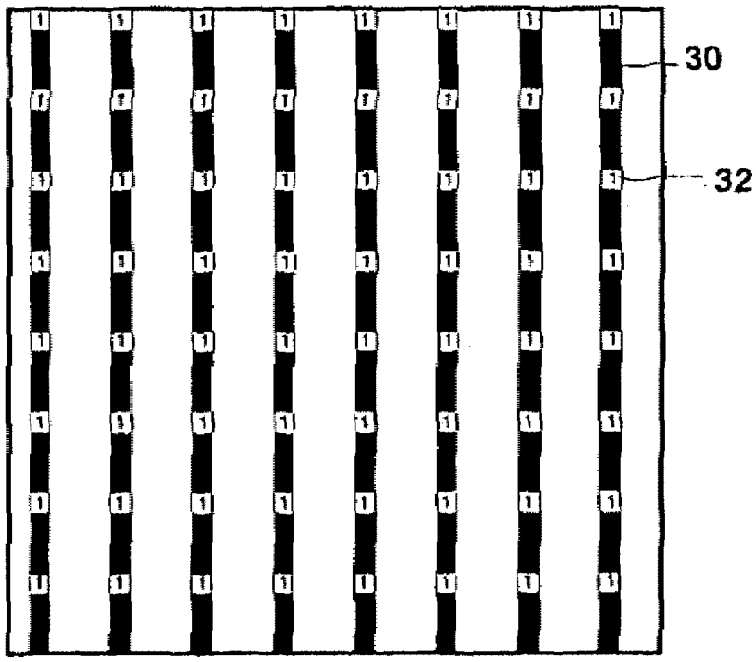
FIG. 3 shows a reconfigurable FSS unit cell geometry for linear polarization, with possible switch locations shown, where each pixel is 1×1 microns (i.e., μm) and the unit cell is 32×32 microns.

FIG. 3 shows a unit cell geometry including fixed metal patches such as 30, and switches such as switch 32. The switches are here represented schematically by the number "1" in a square, in this case representing a switch that is on, so that the unit cell of the FSS comprises eight parallel dipoles extending across the unit cell.

The unit cell is based on a 32×32 pixel array, with the metal patches having a dimension of 1×3 pixels, and the switches occupying a single pixel. This configuration is exemplary, as other arrangements are possible.

A genetic algorithm can be used to optimize the states (i.e., on or off) and/or location of switches. Not every possible location shown in FIG. 3 need have a switch, and the actual states and/or locations can be chosen so as to provide, for example, a stop band at a desired frequency. Other approaches can be used to optimize a RFSS designs, including but not limited to those based on evolutionary programming, genetic algorithms and particle swarm optimization.

The sensitivity of analyte detection can be enhanced, for example, by monitoring reflection, transmission, or absorption at a frequency near the center of a stop band present when either the switches are on or off. A change in the status of the switches will have a large effect on the electromagnetic properties of the FSS at that frequency.

Figure 4:
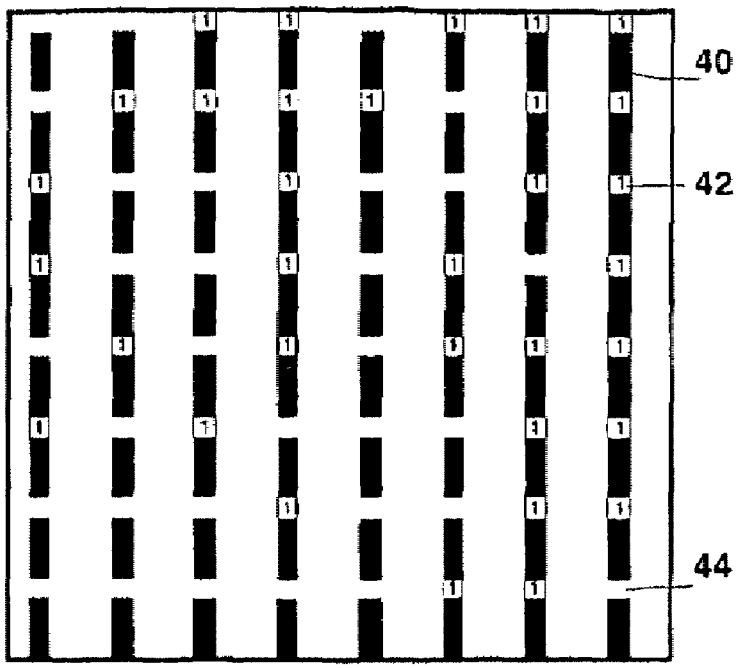
FIG. 4 shows a geometry with switch settings optimized for two stop bands.

FIG. 4 shows an arrangement based on such a genetic algorithm optimization. The metal patches such as 40 have the same geometry as shown in FIG. 3. Switches such as 42 interconnect patches. However, some switch locations indicated in FIG. 3, such as 44, do not have a switch in the on configuration, and the switches in these locations are considered off when calculating the electromagnetic properties. For example, there may be no switch in a location such as 44, or a switch responsive to a different external condition that is not considered on for the modeled configuration (such as a second type of switch responsive to a different external condition).

Figure 5A:
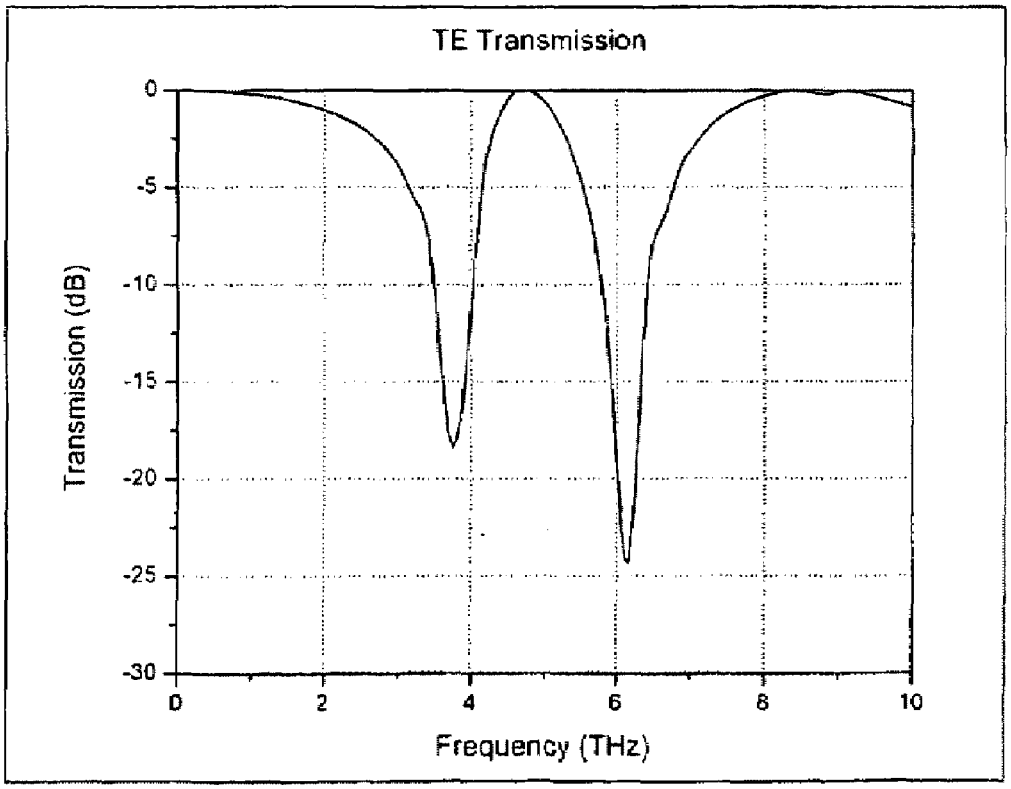
FIGS. 5A and 5B show transmission and reflection spectra (respectively) for a geometry as shown in FIG. 4.
Figure 5B:
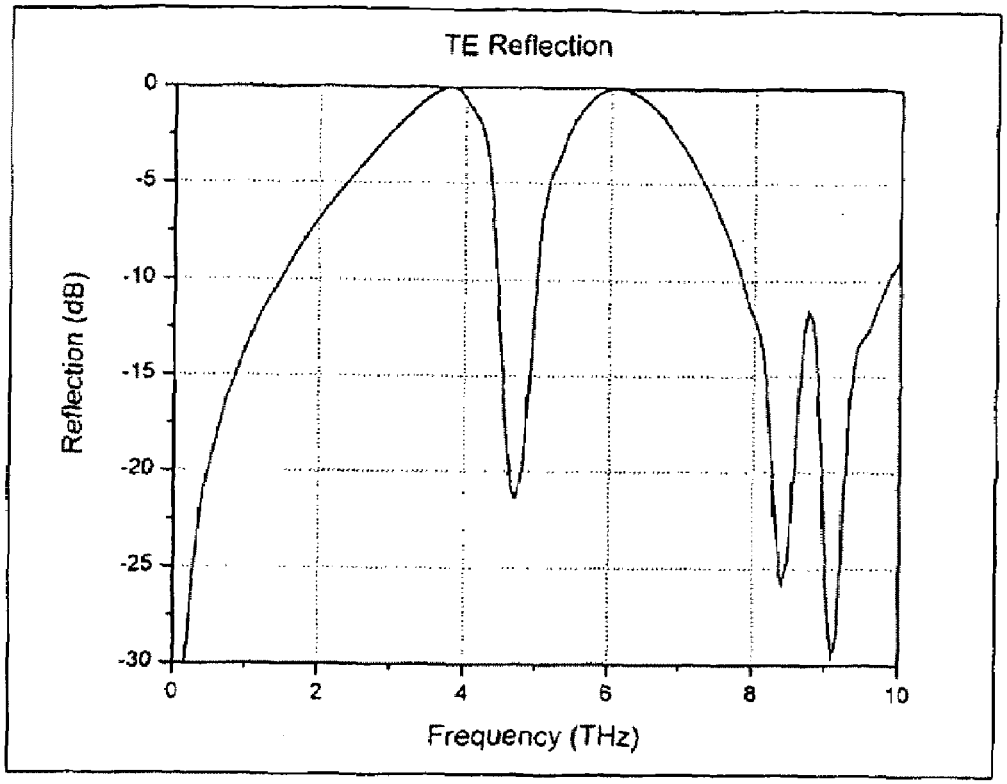

FIG. 5 shows the reflection and transmission of an FSS having the unit cell geometry of FIG. 4, when the switches shown in FIG. 4 are turned on. The transmission spectrum shows sharp stop bands at approximately 3.5 and 6 THz. These frequencies are indicated by the upwardly pointing arrows. In this example, the electromagnetic transmission of an FSS having this unit cell geometry will change dramatically when the switches turn off.

Figure 6:
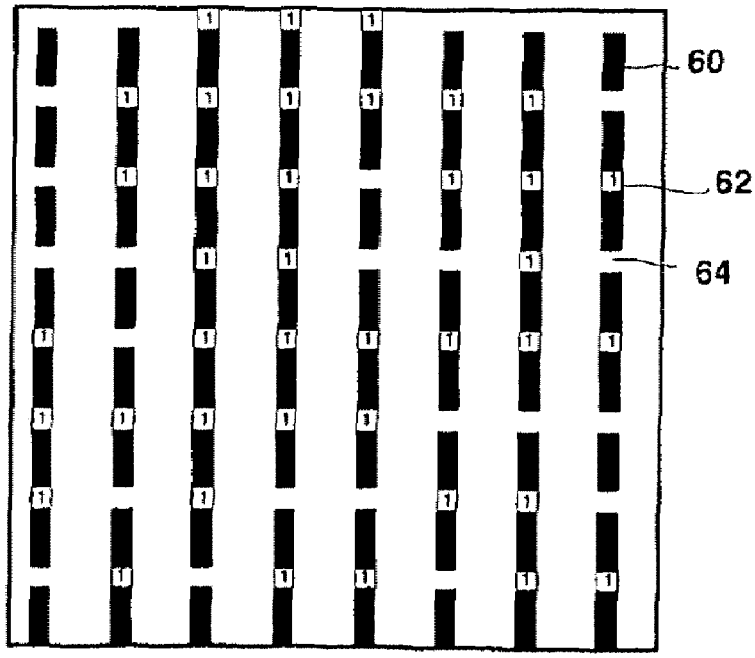
FIG. 6 shows a geometry with switch settings optimized for three stop bands, where each pixel is 1×1 microns and the unit cell is 32×32 microns.

FIG. 6 shows an example unit cell geometry in which the FSS has been optimized to provide three stop bands at approximately 4, 7 and 9 THz. The metal patches have the same configuration as shown in FIG. 3, for example the figure shows metal patches such as 60. Switch locations are as shown as squares enclosing the number "1", for example switch location 62. Other possible switch locations shown in FIG. 3 do not have a switch in the on configuration, for example location 64.

Figure 7A:
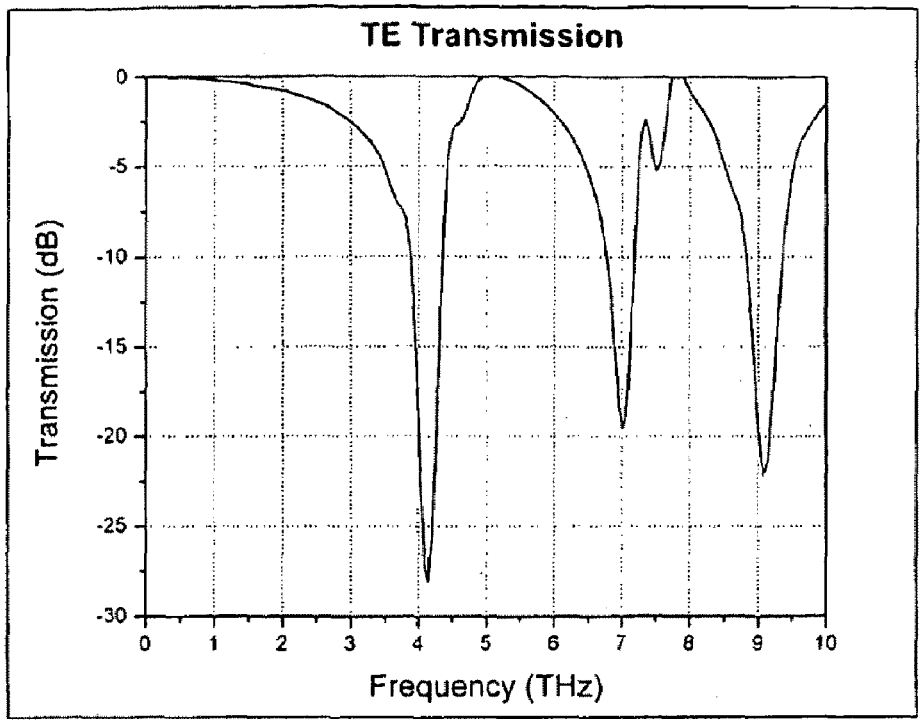
FIGS. 7A and 7B shows transmission and reflection spectra for the geometry of FIG. 6.
Figure 7B:
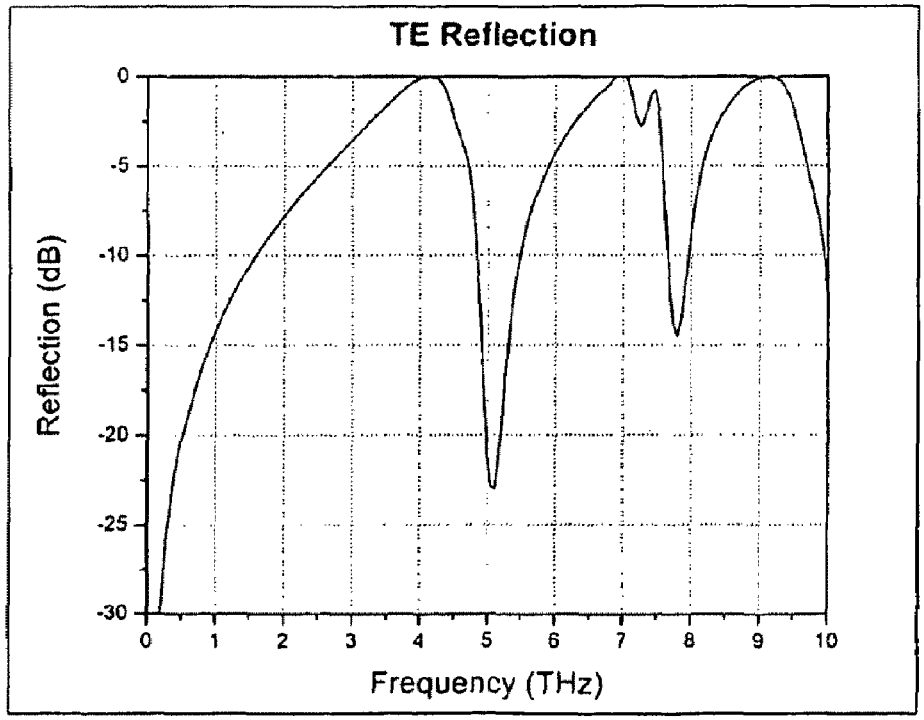

FIGS. 7A and 7B show TE transmission and TE reflection spectra (respectively) for a FSS having the unit cell geometry of FIG. 6, with the switches turned on. The transmission spectrum of FIG. 7A shows three stop bands at approximately 4, 7 and 9 THz, the frequencies being indicated by upwardly pointing arrows. The model used assumes that there are switches at every location (as shown in FIG. 3), this example shows one possible state in which the squares containing the number "1" indicate switches that are on, the other switch locations as shown in FIG. 3 corresponding to switches that are "off".

In other examples of the present invention, different types of switch elements can be incorporated into a single FSS. Each of the different types of switch elements may be designed to respond differently to different chemical analyte mixtures to produce an FSS with pass-band characteristics that depend on the switch element settings. The electromagnetic response of the FSS can be used to determine the presence or otherwise of a plurality of external conditions, for example a presence of one or more of a plurality of different analytes. Different switch types can be provided, so as to allow detection of different types of external conditions.

Figure 8:
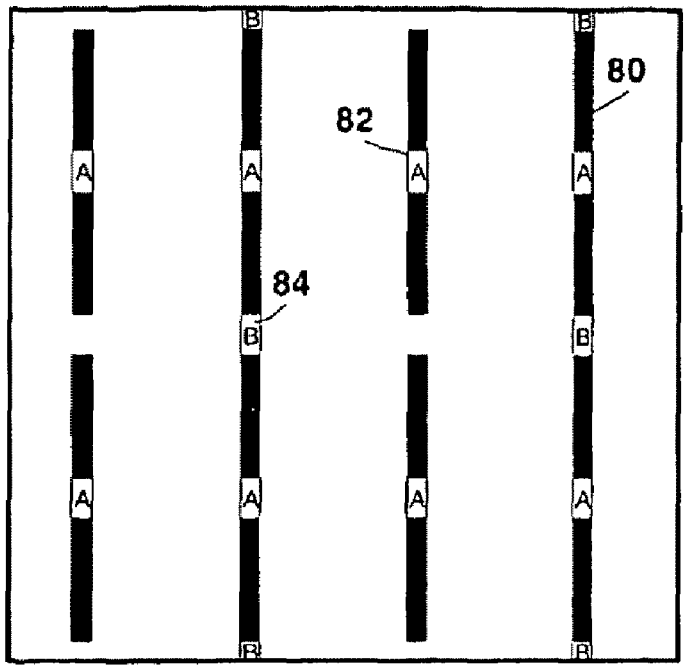
FIG. 8 shows a reconfigurable FSS unit cell geometry demonstrating two independently activated sets of switches, where each pixel is 1×1 microns and the unit cell is 32×32 microns.

FIG. 8 shows an example unit cell of an FSS, including metal patches such as 80, a first type of switch (denoted "A") such as switch 82, and a second type of switch (denoted "B") such as switch 84. The "A" switches are placed in the gaps between every other row of dipoles, and the "B" switches are placed in the other rows of gaps but only connect every other pair of dipole elements in each row.

In examples of the present invention, the two types of switches (A and B in this example) are independently responsive (turned on or off) by different external conditions. The following situations can arise:

a) When both the A and B switches are off, the unit cell geometry consists of a 4×4 array of shorter dipoles that are resonant, and the FSS produces a single stop-band at 22.3 THz.

b) When the switches denoted A are on, and B are off, the unit cell geometry contains a 4×2 array of longer dipoles. The length of the dipoles doubles so that the FSS produces a single stop band at 11.3 THz.

c) When the switches denoted B are on, and A are off, the unit cell comprises alternating columns of short and long dipoles. Because each dipole is resonant at a different frequency, the frequency response of the FSS has dual stop bands at 9.5 and 18.3 THz.

d) When both the A and B type switches are on, the longer dipoles alternate with very long (effectively infinite in the case of a large FSS) metal strips so that the FSS acts as a high pass filter with an additional stop-band at 11 THz.

Figure 9A:
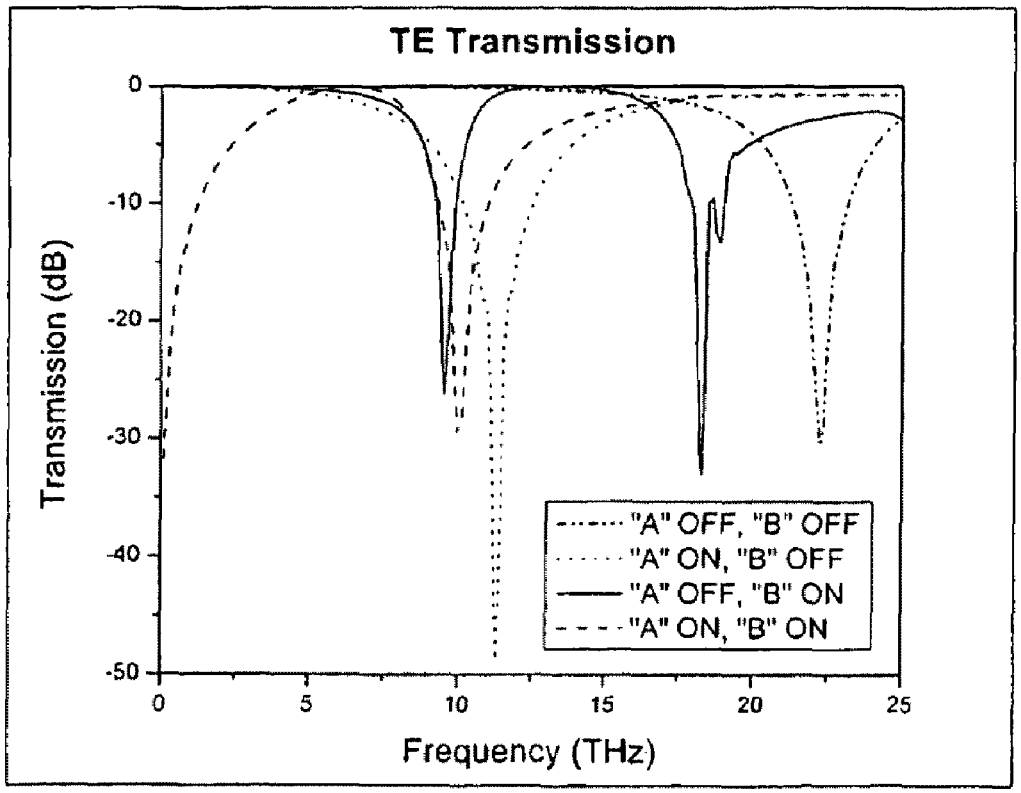
FIGS. 9A and 9B shows transmission and reflection spectra for all four possible switch settings corresponding to the geometry shown in FIG. 8.
Figure 9B:
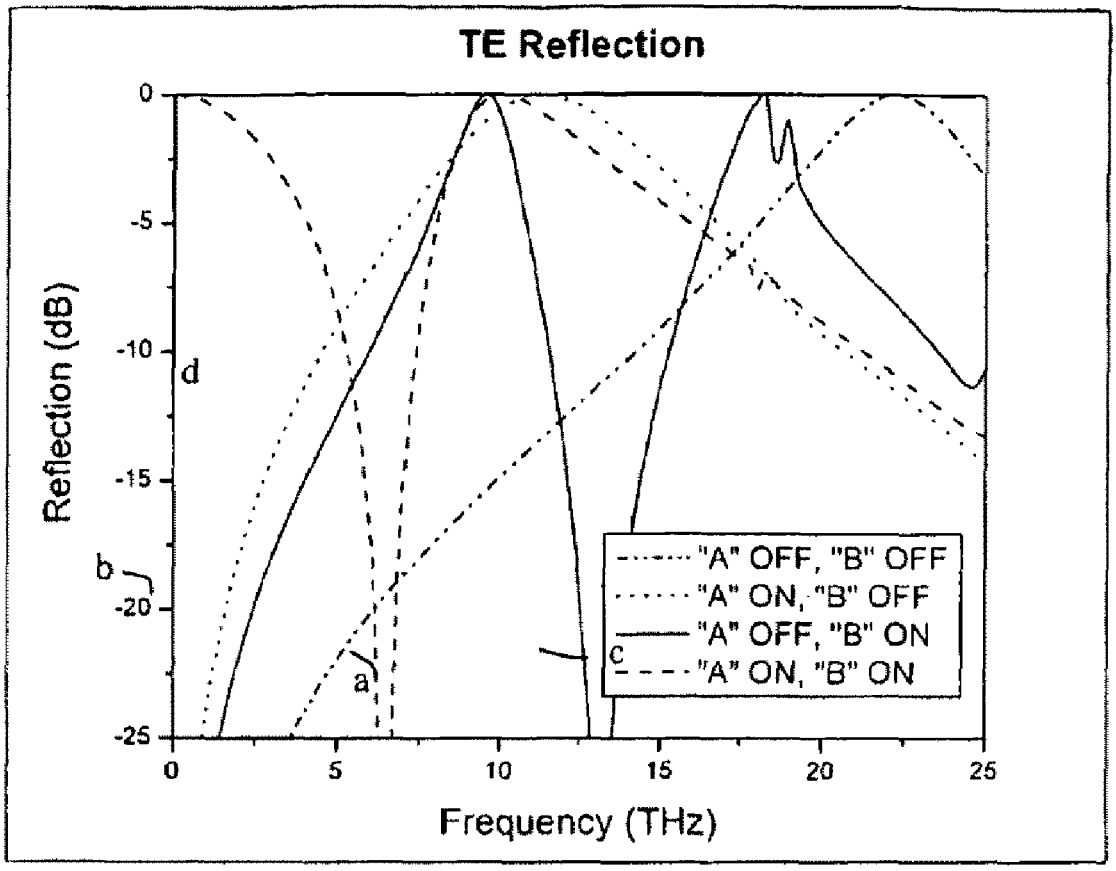

FIGS. 9A and 9B illustrate TE reflection and TE transmission spectra (respectively) corresponding to these four situations. Each configuration, one of the four configurations (a-d) discussed above, of the FSS produces a distinct electromagnetic signature, which may be, for example, a microwave, millimeter wave, infrared, or optical signature. As described previously, a genetic algorithm or other optimization approach can be used to determine the optimal configuration of switch locations required in order to achieve a set of desired frequency responses.

In one example corresponding to FIG. 8, two types of switches that are fabricated using chemoresistive materials sensitive to different target analytes are placed between dipole elements, such that each combination of switch states produces a different backscatter response. The spectra shown in FIGS. 9A and 9B correspond to a pixel size of 1×1 micron, and a substrate thickness of 0.2 microns with a relative permittivity of 2.

The FSS can be used to monitor for the presence of two different analytes. When neither of the analytes is present, there is perfect transmission at all frequencies below 20 THz. If only analyte "A" is present (turning switch "A" on), there will be a distinct stop-band centered at 11.3 GHz where a strong backscattered signal can be detected. On the other hand, if only analyte "B" is present (turning switch "B" on) there will be a strong backscattered signals at 9.5 THz and 18.3 THz. Finally, if both analytes are present simultaneously, there will be a strong backscattered signal at 10 THz as well as at all frequencies below about 2 THz. Hence, such an FSS can be designed to produce large changes in the backscatter signature that depend on the state of the switch settings.

An RFSS design may also produce a distinct electromagnetic response (such as backscatter pattern) when switches (such as chemoresistive switches) are degraded and no longer able to detect a target analyte.

Figure 10:
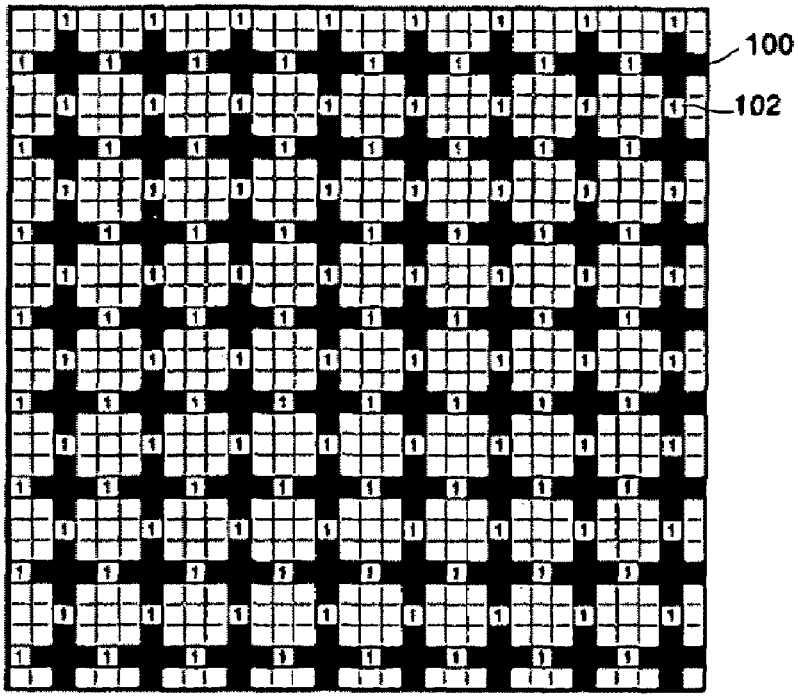
FIG. 10 shows a reconfigurable FSS unit cell geometry for both TE and TM polarizations, showing possible switch locations.

FIG. 10 illustrates a unit cell geometry that can be used to produce a reconfigurable frequency response for both TE and TM polarizations. FIG. 10 shows a plurality of "+" or cross-shaped metal patches, such as patch 100, and a plurality of switches, indicated by the number "1" in a square, such as switch 102. The grid pattern is provided as a visual guide. Each pixel (grid square) is 1×1 microns and the unit cell is 32×32 pixels.

Using a genetic algorithm, the frequency responses for TE and TM polarizations can be individually optimized. The unit cell geometry can contain both fixed cross-shaped metal patches (a cross-shaped dipole pattern) and switches located at one or more locations, such as the possible locations indicated in FIG. 10, which can be individually enabled (connected) or disabled (disconnected). A first target frequency response can be specified for the TE polarization, and a second target frequency response can be specified for the TM polarization. A genetic algorithm (GA) can be used to find a set of switch states that achieves the target responses. A goal in this case can be to identify the optimal switch configuration that would lead to a desired target frequency response for horizontal polarization and another target frequency response for vertical polarization.

For example, switches can be provided in all locations shown in FIG. 10, and a selection of switches enabled to provide desired electromagnetic response(s). The unit cell geometry can provide either the same or a different frequency responses for vertical and horizontal polarizations. For example, switches may be individually enabled or disabled to obtain desired responses. A genetic algorithm can be used to determine which switches should be enabled and which ones should be disabled in order to produce the desired TE and TM responses.

Figure 11:
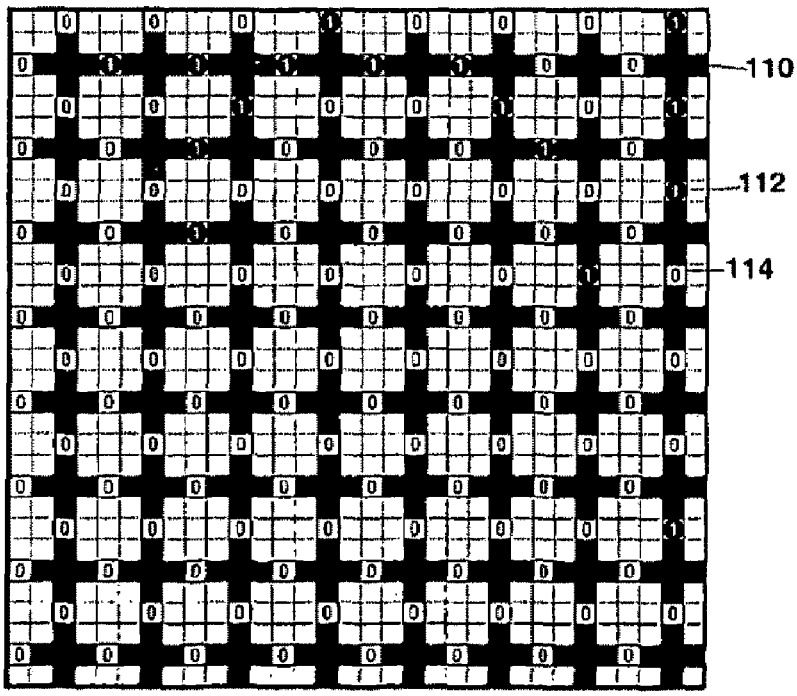
FIG. 11 shows an FSS unit cell geometry optimized to produce two stop-bands, one at 8 THz and one at 4 THz, for a TE and a TM polarized wave respectively.

FIG. 11 shows a unit cell geometry that comprises a periodic metallic crossed-dipole pattern, including metal patches such as 110. The pattern of metal patches is the same as shown in FIG. 10 above. The unit cell further comprises a set of switches in the on configuration, such as switches 112, indicated by the number 1 inside a circle. A "0" inside a circle indicates that a switch that is off, as shown at 114. The unit cell configuration has been optimized (in this case using a genetic algorithm technique) to produce two stop-bands; one at 8 THz for a TE (transverse electric) polarized wave and the other at 4 THz for a TM (transverse magnetic) polarized wave.

Figure 12A:
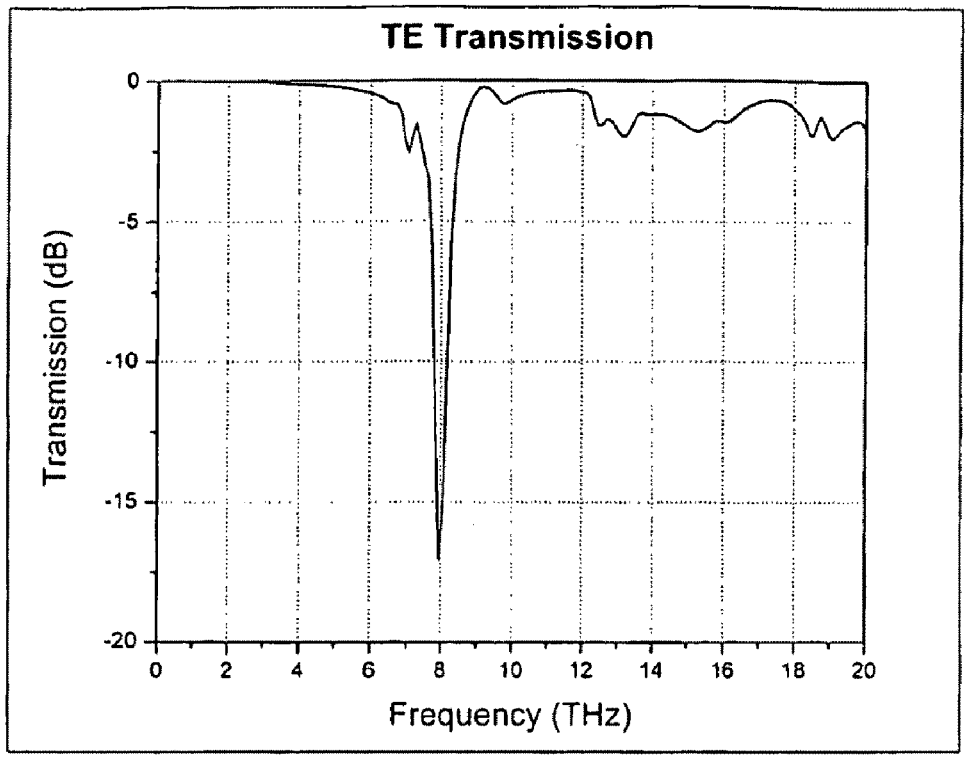
FIGS. 12A-12D show transmission and reflection spectra for the FSS unit cell geometry shown in FIG. 11.
Figure 12B:
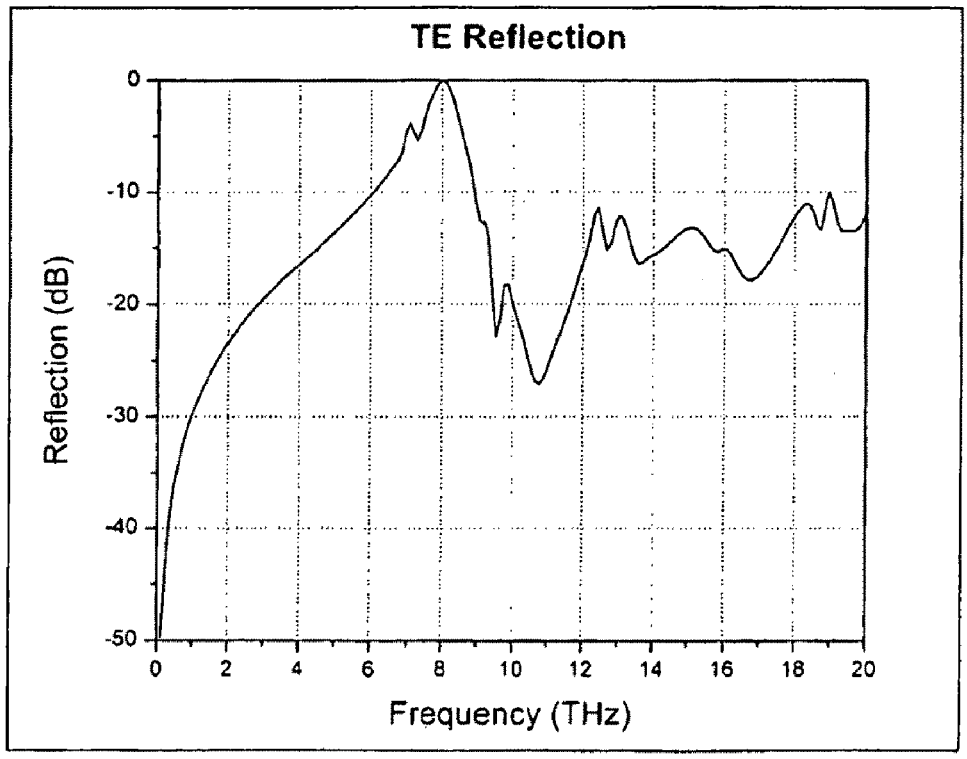

FIGS. 12A and 12B show TE transmission and reflection spectra (respectively) corresponding to an FSS having the unit cell configuration of FIG. 11.

Figure 12C:
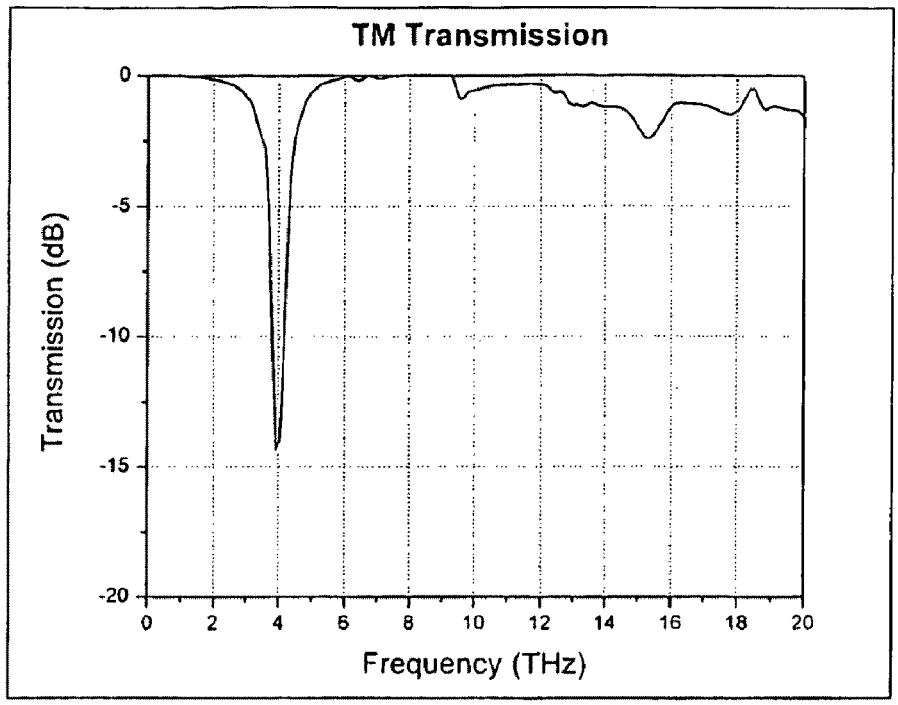
Figure 12D:
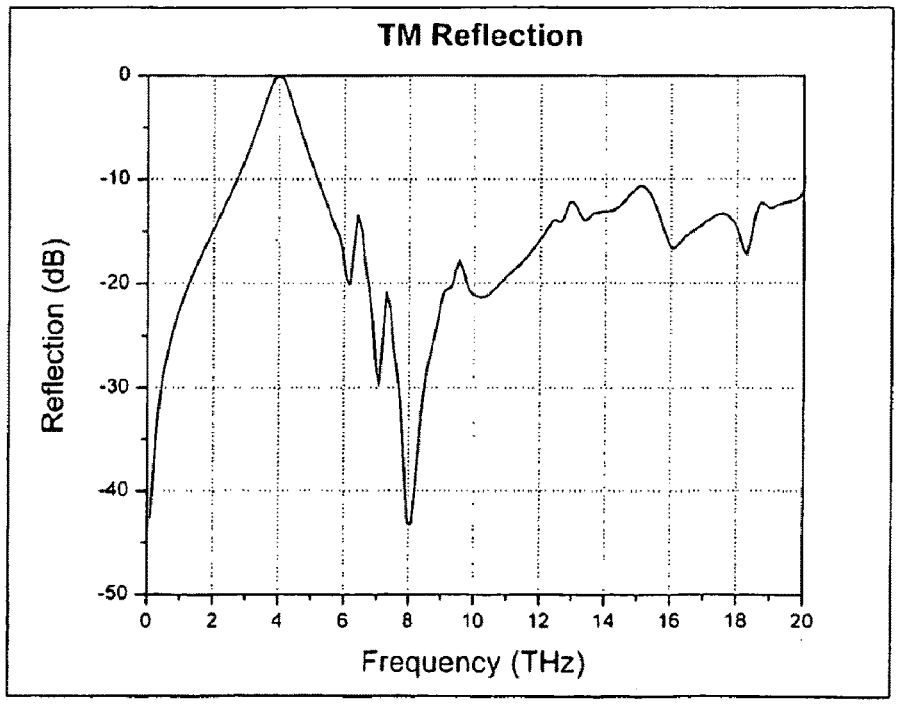

FIGS. 12C and 12D show the corresponding TM transmission and reflection spectra (respectively) of the FSS.

The above examples demonstrate the flexibility of the reconfigurable FSS design methodology, wherein the crossed-dipole pattern can be optimized for a variety of target frequency and polarization responses and the corresponding switch settings can be stored in a look-up table for future reference.

Figure 13:
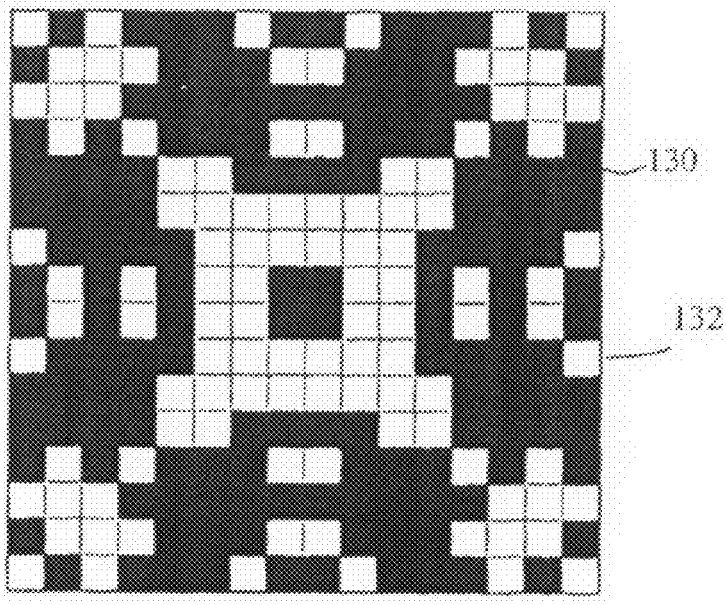
FIG. 13 shows the unit cell of a single band absorber design.

FIG. 13 shows the unit cell for a single band absorber design. The dark area (130) corresponds to a conductive material, and the light area (132) does not have the conductive material. The grid pattern visible in the light area is for visual guidance only.

In this example, the FSS thickness is 200 microns (the thickness of the metal screen). The following parameters were optimized using a genetic algorithm: cell size is 2.65 cm×2.65 cm; substrate thickness is 1.8 mm; and substrate permittivity is 3.52.

Figure 14A:
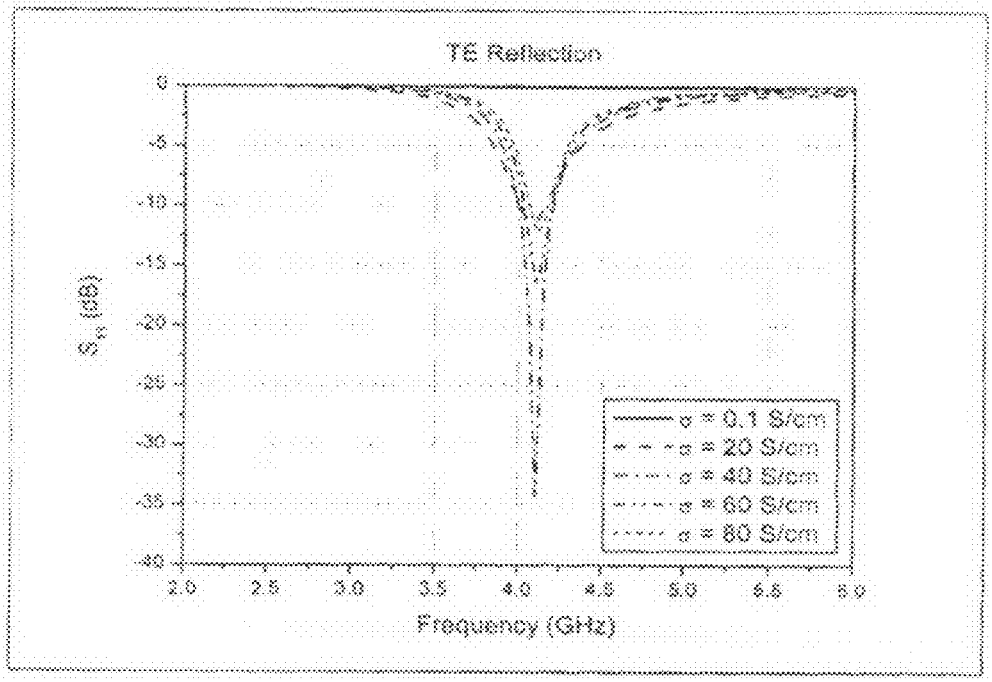
FIG. 14A illustrates TE reflection spectra of the absorber of FIG. 13 as a function of the electrical conductivity of the conductive material.

FIG. 14A illustrates TE reflection spectra as a function of the electrical conductivity of the conductive material. There is a sharp stop band near 4 GHz, and the depth of the stop band is correlated with the electrical conductivity. Hence, the TE reflectivity at a frequency near 4 GHz can be correlated with an external condition that modifies the conductivity of the conductive material. For example, an analyte may modify the conductivity of a chemoresistive material, modifying the response of an FSS including the chemoresistive material.

A genetic algorithm was used to synthesize the absorber FSS geometry required to achieve high absorption at the desired operating frequencies with a minimum on state screen conductivity. The optimized unit cell size for this example is 2.65 cm by 2.65 cm, the dielectric substrate relative permittivity is 3.52, and the dielectric substrate thickness is 1.8 mm. The FSS thickness is assumed to be 200 microns in this calculation.

Figure 14B:
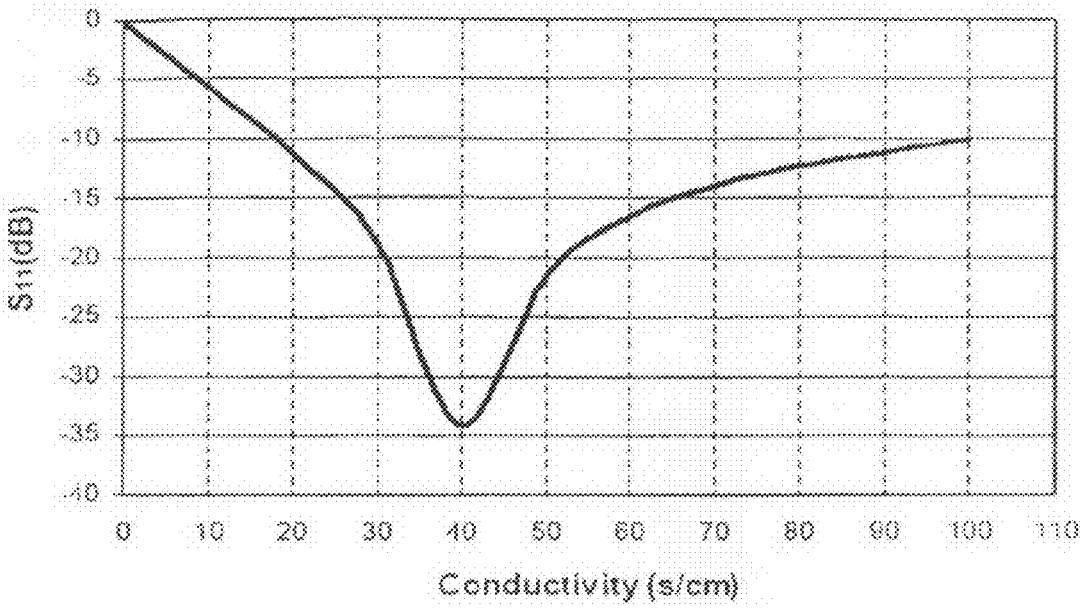
FIG. 14B shows the depth of the stop band of the absorber as a function of the conductivity of the conducting material.

FIG. 14B illustrates the correlation between the depth of the stop band and the conductivity of the conducting material. The reflection spectrum of the absorber is shown for a range of FSS screen conductivities.

The above example illustrates that an FSS unit cell may be formed from a chemoresistive material screen, and need not include fixed metal patches.

Figure 15:
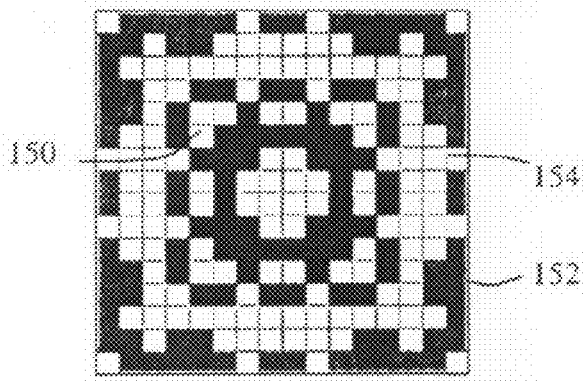
FIG. 15 shows an FSS unit cell geometry for a dual-band absorber.

FIG. 15 shows an FSS unit cell geometry for a dual-band absorber. Two materials are used, each having a conductivity responsive to a different external condition. The figure shows a region of first material 150, a region of second material 152 (generally located around the periphery) and light-colored regions representing no material (154). In one example, the first material is a first chemoresistive material responsive to a first analyte, and the second material is a second chemoresistive material responsive to a second analyte. The regions 152 and 154 can be deposited as a screen on a substrate.

A possible value of conductivity for this design in the on state is 120 S/cm, and in the off state is 0.1 S/cm. The FSS screen geometry was optimized by a genetic algorithm, and has a unit cell size of 1 cm by 1 cm, and an FSS screen thickness of 1 micron. The substrate thickness and permittivity used in modeling were 1.1 mm and 3.0 respectively, though other values are possible.

Figure 16:
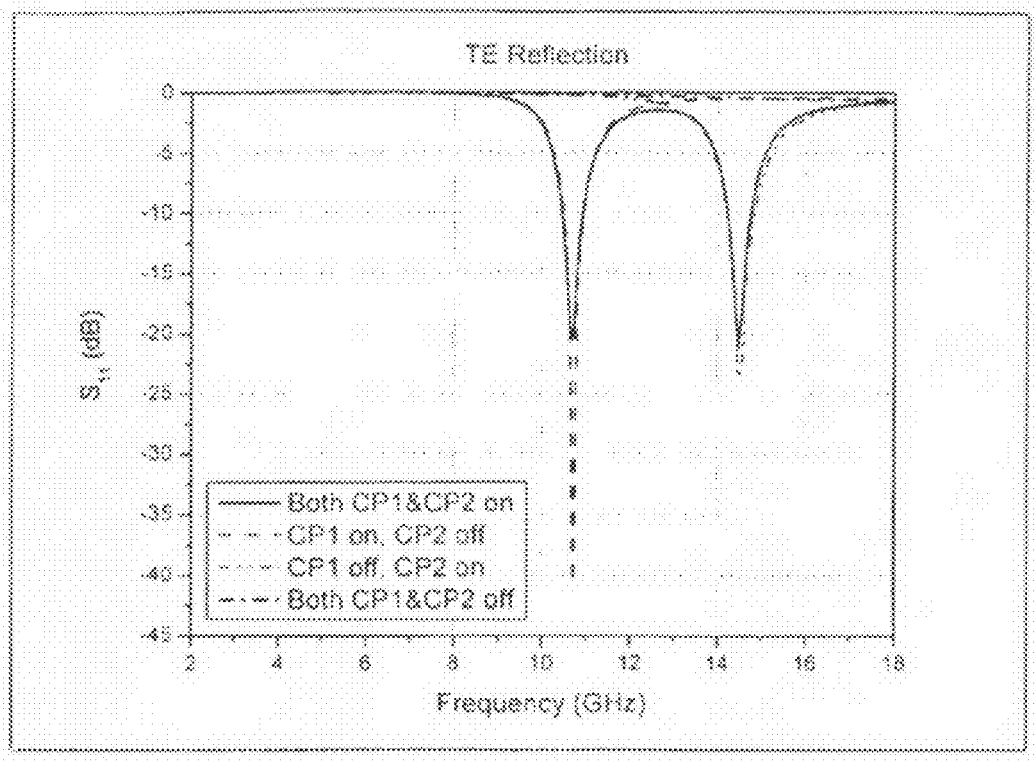
FIG. 16 shows TE reflection spectra of the FSS screen of FIG. 15, showing dual absorption bands at 10.5 and 14.5 GHz.

FIG. 16 shows TE reflection spectra of the configuration of FIG. 15, showing dual absorption bands at 10.5 and 14.5 GHz. Reflection spectra were computed for four conditions, assuming a first conducting polymer (CP1) used as the first material, and a second conducting material (CP2) used as the second material. Spectra correspond to when both of the materials are in the on state (maximum conductivity), when each conducting polymer is on with the other conducting polymer off, and when both conducting polymers are in the off state (minimum conductivity).

An electromagnetic bandgap absorber design can be used with switch materials that possess a relatively low on-state conductivity (<100 S/cm) and modest dynamic range (for example, less than a factor of 10 change in conductivity in response to chemical analyte exposure). Typical chemoresistive conducting polymers can be used. A lower on-state conductivity may require a thicker layer of conducting polymer, such as tens of microns and thicker. The surface area of a chemoresistive film can be increased by surface topography (such as grooves), porous films, and the like, to increase surface area and sensitivity to an analyte. For example, porous conducting polymer films based on fabrics or fibers can be used.

An electromagnetic bandgap absorber would also work well with switches based on chemically sensitive semiconductor nanowire networks, for example a randomly oriented nanowire network of net thickness in the microns range (0.5-1000 microns). The dc conductivity of nominally undoped silicon nanowires with 80-100 nm diameter can change by several orders of magnitude (on-state conductivity ~1 S/cm) by exposure to different gases because of the large nanowire surface area. The on-state conductivity of semiconductor nanowires can be increased using intentional dopants such as phosphorous. We have observed an on-state dc conductivity of 1000 S/cm in intentionally doped n-type silicon nanowires. The surface of a nanowire can be further treated to enhance selectivity and/or sensitivity to particular analytes, for example by providing binding sites.

Figure 17:
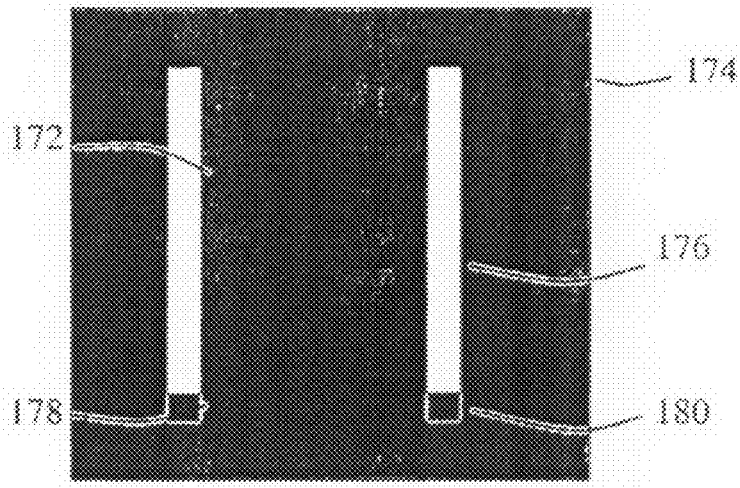
FIG. 17 illustrates a unit cell design comprising dipole slots in a metallic plane.

FIG. 17 illustrates another approach, in which slots, apertures, and the like are formed in a metallic (or other conducting) screen. FIG. 17 shows first and second dipole slots, 170 and 172 respectively, in a metallic screen 174. First and second switches 176 and 178 are located adjacent to the ends of the first and second slots, respectively.

In this example, the cell dimension is 4.6 cm×4.6 cm, the pixel resolution is 16×16, the switch dimension is 0.2875 cm×0.2875 cm, and the substrate has a thickness d=0.11 cm, and relative permittivity $\in_r$=3.0. The unit cell geometry includes an FSS screen on a substrate with thickness of 0.11 cm and permittivity of 3.0. For on-state resonance near 4 GHz, the unit cell dimension is 4.6 cm×4.6 cm; and for operation near 9 GHz, the unit cell dimension is 1.8 cm×1.8 cm.

The length of the switch is determined by the amount of shift in resonance desired. In this example, the switch length is 0.2875 cm, producing a frequency shift of 300 MHz. The stop band frequency with switches on is 4.21 GHz, and with switches off is 3.91 GHz. When the switches are off (low conductivity), this effectively lengthens the length of the slots, shifting the resonant frequency and frequency response.

Figure 18A:
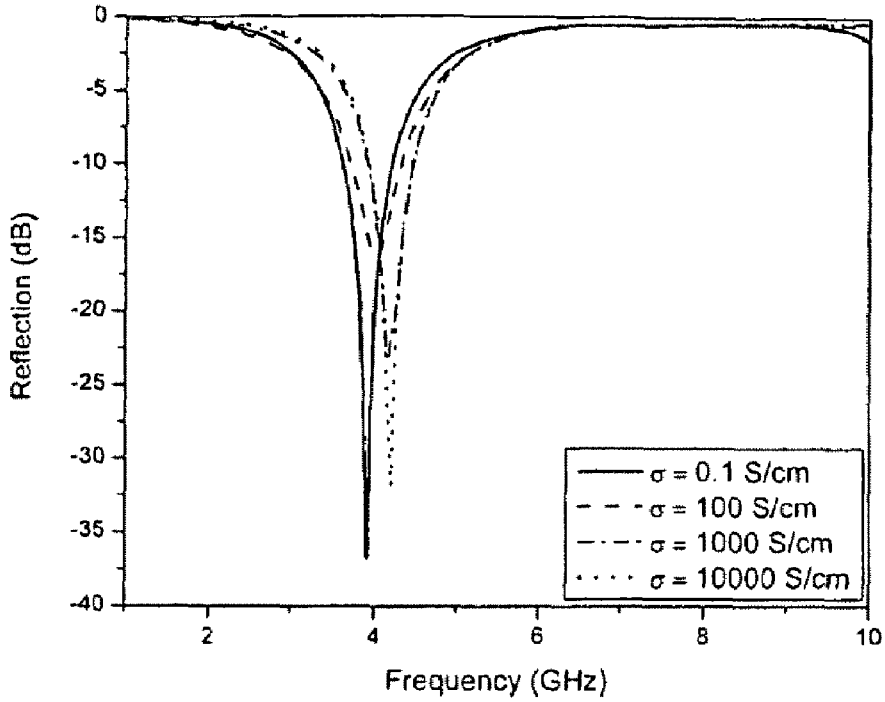
FIG. 18A illustrates reflection spectra of the configuration of FIG. 15 as a function of the conductivity of the switches.

FIG. 18A illustrates a reflection frequency response of the configuration of FIG. 17 as a function of the conductivity of the switches. In effect, this models the response of an FSS having a chemoresistive material in the locations of the switches, as a function of the conductivity of the chemoresistive material. The changes in frequency response are correlated with the conductivity, and hence can be correlated with the presence of an analyte that induces changes in the conductivity.

The four curves correspond to conductivities of 0.1, 100, 1000, and 10,000 S/cm respectively. A low conductivity is closer to a perfect off state, and a high conductivity is closer to a perfect on state.

Figure 18B:
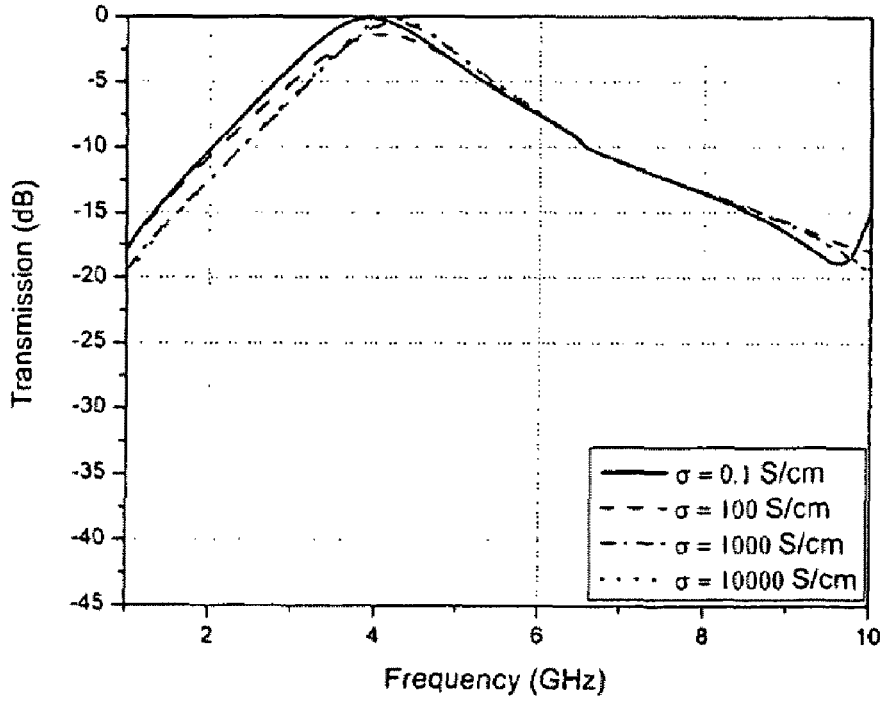
FIG. 18B shows corresponding transmission spectra.

FIG. 18B shows the corresponding transmission spectra, which do not have a stop band.

The configuration shown in FIG. 17 may be used with narrow band radar. The frequency changes are smaller than in other examples discussed, which is advantageous used with a narrow band source.

When used with existing radar systems, for example for remote detection of analytes, bandwidth considerations suggest a frequency shift between the on and off states around 300 to 500 MHz, with center frequencies at 4 and 9 GHz, respectively. However, examples of the present invention can be used with a radar system having any operating frequency or combination of frequencies and any bandwidth.

For example, chaff including one or more FSS structures can be deployed into the atmosphere, and the electromagnetic response of the chaff monitored using radar reflection. In examples of the present invention, the presence of an analyte in the atmosphere modifies the electrical conductivity of a chemoresistive material used in fabrication of the FSS, which then changes the resonant frequency or other electromagnetic property of the FSS. A resonant frequency change can be readily detected by analyzing a radar reflection spectrum from the chaff. The chaff could also include one or more dipole antenna scatterers made of metallic ribbon with chemoresistive switches placed at strategic locations along the ribbon. These switches would change their state in the presence of a specific analyte thereby changing the length and the corresponding resonant frequency of the dipoles, which could readily be detected by an interrogating radar.

A plurality of chaff types can be dropped or otherwise deployed into the atmosphere, each chaff type sensitive to a different analyte. Alternatively, a single FSS (or antenna) design can include different types of chemoresistive material sensitive to different analytes, and the FSS (or antenna) design configured to allow detection of the presence of one or more analytes. A single piece of chaff can include a plurality of FSS (or antennas), each sensitive to one or more external conditions.

The chaff can be in the form of a metal ribbon, including slots arranged in a periodic pattern, in the form of an FSS, and chemoresistive elements sensitive to the presence of one or more analytes. Backscatter from radar or lidar systems can be used to detect the analyte. This approach can be used to detect atmospheric pollution (in all layers of the atmosphere, including the upper atmosphere).

In other examples, the empty slots can be replaced by strips or other structures of chemoresistive materials disposed within a metallic plane.

Figure 19:
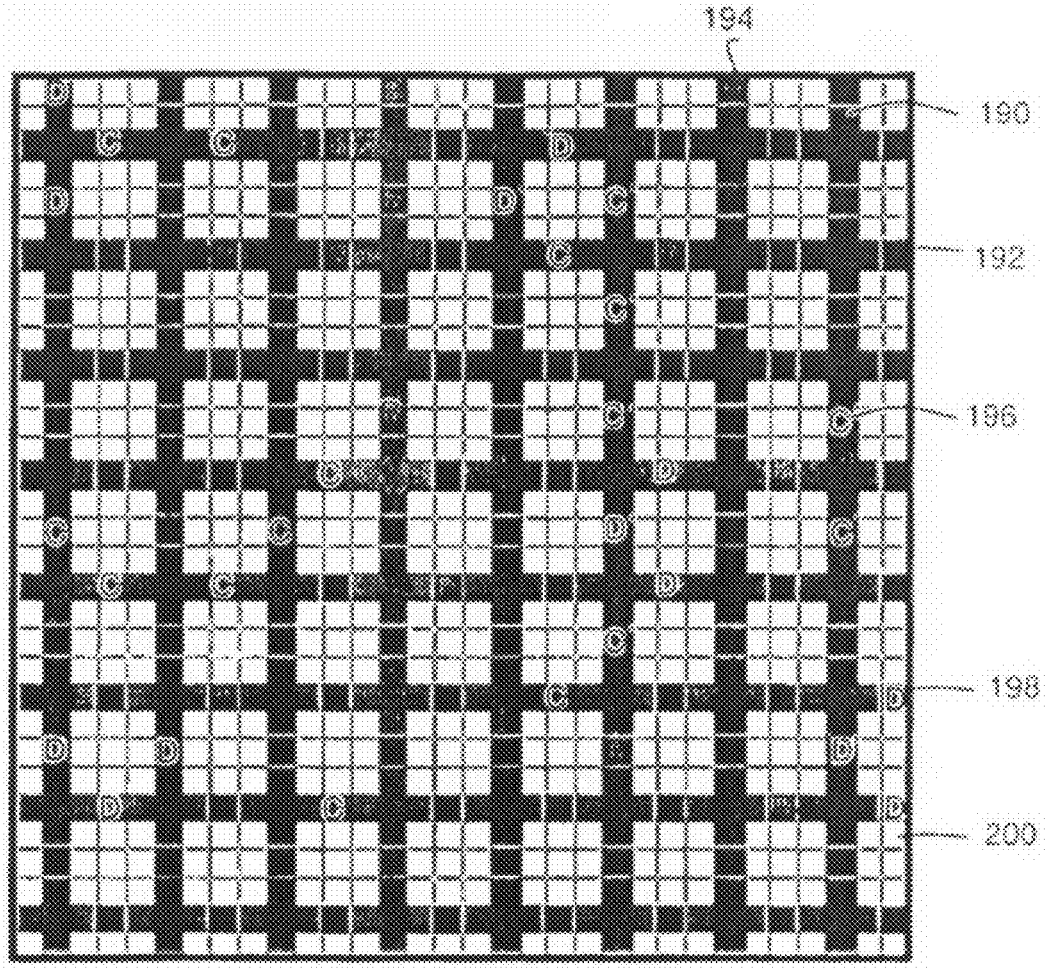
FIG. 19 shows a unit cell configuration incorporating four different types of chemoresistive switches into a cross-dipole array.
Figure 20A:
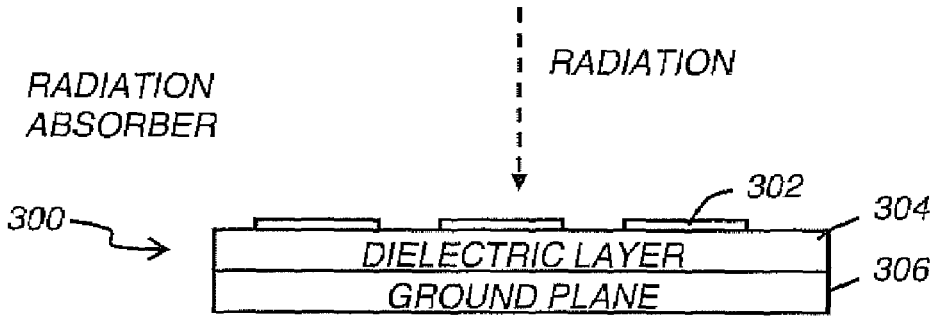
FIG – 20A (PRIOR ART)
FIGS. 20A-20C show a conventional electromagnetic reflector, electromagnetic absorber, and antenna.
Figure 20B:
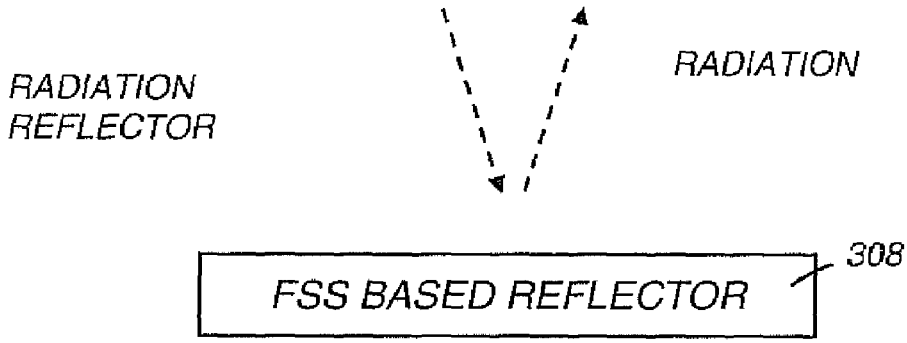
FIG – 20B (PRIOR ART)
Figure 20C:
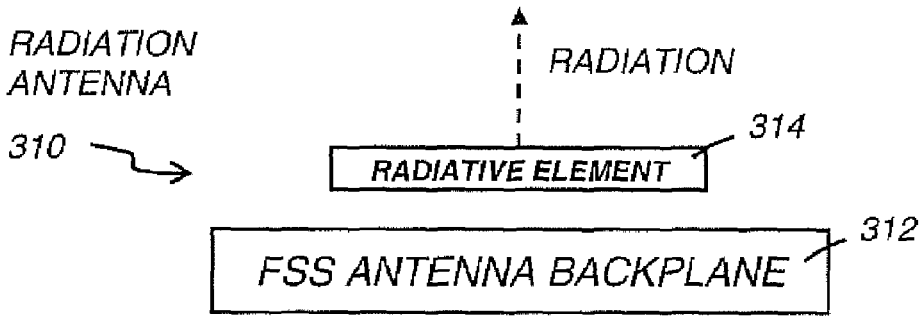
FIG – 20C (PRIOR ART)

FIG. 19 shows an example of a unit cell that incorporates four different types of chemoresistive switches into a cross-dipole array. The unit cell comprises metal patches having a cross shape, such as fixed metallic cross-dipole 190, and switches of the type A (such as 192), B (194), C (196), and D (198). The light color regions such as 200 correspond to regions with no metal. The grid pattern in the light color regions is provided as a visual guide only.

The FSS unit cell consists of an 8×8 array of metallic cross-dipoles interconnected by a matrix of four different types of chemoresistive switches, each sensitive to a different target analyte (i.e., A, B, C, and D).

Many other periodic geometries are possible, including those designed using a genetic algorithm approach. The RFSS design will depend on various factors including the operational frequency band and RF power requirements desired; the desired size, weight, and form factor of the RFSS; the desired backscatter signature pattern; the actual RF response of different chemoresistive sensor switch technologies, and the back-end pattern recognition and classification strategies desired.

In several of the above examples, the switches are modeled as ideal, i.e., either on with no resistance, or off with infinite resistance. However, examples of the present invention also include elements having a more realistic response, for example where chemically or biologically sensitive switches are not completely selective to different chemicals and have a range of conductivity states between an ideal on or off. In such case, the signature (for example, electromagnetic response) of the RFSS is more complicated to interpret. However, this problem is similar to those being addressed by other sensor platforms, including on-chip conductivity based sensors. In these sensors, the sensor chip is often trained under a variety of exposure conditions prior to use. The response that is collected during operation can then be evaluated using pattern recognition algorithms (e.g., neural networks etc.) to determine the chemical analyte mixture present. This approach can also be extended to RFSS unit cell patterns according to the present invention.

Genetic algorithms can be used to design fractal surfaces that produce a desired frequency response that is frequency and/or polarization sensitive. Such patterns are particularly useful in many practical samples when it is necessary to accommodate properties such as lossy switches, metals, and substrates and surfaces with finite substrate thickness.

Hence, a unit cell of an FSS may comprise elements having an electrical resistance correlated with an external condition, which can be used in place of (or in addition to) switches having distinct on and off states. The electromagnetic response of an FSS including such elements can be modeled, and the model used in detection of the external condition. For example, the presence (or concentration) of an analyte can be correlated with an electromagnetic response of an FSS at one or more predetermined frequencies.

The FSS switches can be fabricated using materials that change conductivity state in the presence of certain chemical or biological analytes. Examples of such materials include chemically or biologically sensitive conductive polymers. The most common conductive polymers include derivatives of polythiophenes, polypyrrole and polyaniline, which have been shown to change their conductivity state by many orders of magnitude in the presence of chemical analytes. These conductive polymers have been shown to have sufficiently high conductivity in the frequency range of interest for these sensor applications (microwave and infrared) to serve as effective switch elements for the FSS.

The conductivity of such materials has been enhanced by building percolation threshold composites that include carbon black, nanowires and carbon nanotubes. These conductive polymer materials are often extremely sensitive but not selective to particular analytes (i.e., conductivity changes are observed for more than one chemical). Moreover, the change in conductivity is proportional to the concentration of chemical that is present. Other molecular systems are also being developed with excellent selectivity to particular chemical and biological species. Materials that can be used to fabricate the switches of the present invention are not limited to conductive polymers and their derivatives, but instead include any class of materials that is capable of changing its conductivity state in the presence of chemical or biological analytes.

Incorporating chemically or biologically sensitive switches in predefined patterns on the RFSS allows it to automatically reconfigure to produce a distinct RF, IR or optical signature in the presence of different chemical analyte mixtures.

A sensor system may comprise an FSS and a remote device, operable to illuminating the FSS with a source of radiation of the desired frequency range and to identify the presence of analytes based on the reflection or transmission spectra that are generated. For example, a military application of the sensor system involves applying the RFSS on an unmanned aerial vehicle or as part of an unattended ground sensor, which can be remotely interrogated to detect the presence of chemical analytes and/or biological agents. This has advantages over other sensing approaches because the entire sensor is passive and does not require an on-board source of energy. Moreover, such surfaces can be fabricated on flexible substrate materials such that they can be easily mounted onto a variety of platforms. Militarily significant examples include tanks and next generation soldier suits.

Chemoresistive sensor switches preferably produce large changes in RF conductivity in response to analytes, while exhibiting low dielectric loss for the RF frequency bands of interest. Different physical mechanisms can be used, such as a chemically sensitive conducting polymer, a percolation threshold polymer/metal nanowire composite, or a chemically sensitive field effect transistor (ChemFET).

Examples of the present invention use chemically sensitive conductive polymers as chemoresistive elements in switches. Suitable polymers are disclosed in U.S. Pat. No. 6,323,309 to Swager et al. For example, the DC conduction pathway along a polymer backbone can be broken upon binding of an analyte, corresponding to a switch formed from the polymer conducting or on when a target analyte is not present and non-conducting or off when the target analyte is present. The RF properties of a chemoresistive polymer may not be identical to the DC properties, but operational devices are possible. The polymers may be also lossy, requiring a trade-off of sensitivity and other operational parameters.

The sensitivity of a device is correlated with the number of parallel-connected polymer wires. The sensitivity increases as the polymer film becomes very thin, i.e., a single conduction channel between electrodes can provide molecular level sensitivity.

Chemoresistive conducting polymer switches may show resistance changes that depend on the exposure concentration and time. Non-ideal concentration and time dependent resistance changes can be corrected by, for example, using a system modeling algorithm. Further, patterning processes used to fabricate chemoresistive polymer switches may modify the polymer properties.

Percolation threshold polymer/nanowire composites can also be used as a sensor switch. Lewis et al. demonstrated that it is possible to achieve large changes in DC conductivity by incorporating carbon black within a nonconductive organic polymer matrix such that the carbon black forms an interconnected matrix at the percolation threshold for conduction (See, for example, U.S. Pat. No. 6,773,926, to Lewis and co-inventors, and Dai et al.; "Sensors and sensor arrays based on conjugated polymers and carbon nanotubes," *Pure Appl. Chem.*, Vol. 74, No. 9, pp. 1753-1772, 2002). The organic polymer matrix undergoes a conformational change (i.e., swelling) in the presence of a particular analyte or class of analytes. The swelling causes the carbon black matrix to disconnect, which results in a significant drop in the dc conductivity of the sensor.

Suitable nonconductive polymer matrices are known for a range of organic vapors, and more recently for several nerve agent simulants and explosives. Similar percolation threshold sensors that incorporate template synthesized gold metal nanowires should have improved RF properties (i.e., conductivity and loss) well suited for an RFSS according to the present invention.

For example, metal nanowires can be self assembled into dendritically connected networks using an external field applied directly to the patterned FSS prior to applying the nonconductive polymer across the entire RFSS. Although this switch requires a multi-step fabrication approach, it eliminates the need for patterning a chemically sensitive polymer. The resistance change of such percolation threshold sensors are expected to be more abrupt than the chemically sensitive chemoresistive polymers described previously. This type of non-ideal response can also be modeled to improve analytical accuracy.

Chemically sensitive field effect transistors can also be used as an RFSS sensor switch. Operation involves modulating the carrier density in nominally undoped silicon (or amorphous silicon; a-Si) through analyte binding, which induces a charge at the gate of the transistor. In conventional ChemFET technology, the channel resistance is modulated by changing the amount of inversion charge underneath the gate. Here, the introduction of carriers in the semiconductor will change the plasma frequency of the material and hence the RF conductivity of the material. In fact, this concept can be used for an improved RFSS design by optically exciting, for example using IR radiation, regions, such as masked regions, of a planar slab of intrinsic silicon. In this example, a FSS responsive to an external condition (IR radiation) is provided.

A variety of chemically sensitive gate materials could be used, including polymers and self-assembled monolayers with chemical recognition units. An RFSS can also be interrogated by activating the same switch optically as well as chemically.

Further Discussion Concerning Optimization

A genetic algorithm can be used to optimize an FSS geometry (such as a reconfigurable dipole pattern) for a variety of desired frequency responses. These optimized configurations can be placed in a database to be retrieved when reconfiguring the FSS to a desired frequency response. Although it may require some time to optimize the pattern for a set of target frequency responses, the optimizations only need to be performed once. Specific configurations can then be quickly retrieved from a database and implemented to reconfigure the FSS in real time or analyze the resulting FSS signature.

For example, an FSS unit cell can include switches at a plurality of different locations within the unit cell. A first selection of switches can be disabled (locked in an on or off state) so they are not sensitive to an external condition. A second selection of switches can be enabled, so that they are sensitive to an external condition. The selection of disabled or enabled switches can be optimized for a desired electromagnetic response. The selection of disabled or enabled switches can also allow the sensitivity of the FSS to be tailored, and allow a single FSS to be configured so as to be sensitive to one or more of a plurality of external conditions.

For example, suppose that a particular chemoresistive material (such as a conducting polymer) possesses a range of conductivities under different external conditions. The extremes of the conductivity range can be considered the on (highest conductivity) and off (lowest conductivity) states for the material. Hence, a design goal may be to minimize the required change in material conductivity to achieve a desired change in FSS response. In the case of absorber designs, a genetic algorithm was used to optimize the geometry of the FSS screen, the size of the unit cell, the thickness of the substrate, and the permittivity of the substrate to generate the best on and off state performances at the desired operating frequencies of the absorber.

Full-wave electromagnetic analysis tools in conjunction with a robust genetic algorithm optimization procedure can be used to design the required RFSS configurations. A figure of merit (FOM) can be developed for RFSS design parameters, such as the configuration and size of the FSS unit cell as well as the dielectric constant and thickness of the substrate material. The desired conductivity of the switch materials could also be a parameter in the design optimization.

The effects of non-ideal switch elements on the performance of candidate RFSS designs can be modeled by using full-wave computational electromagnetic modeling techniques such as periodic Method of Moments (MoM), periodic Finite Element Boundary Integral (FEBI) methods, and periodic Finite-Difference Time-Domain (FDTD) methods. These electromagnetic analysis techniques can be used to model the effects of non-ideal switch materials that can experience changes in RF conductivity over several orders of magnitude in response to the targeted analytes. The outcome of this analysis can help to establish the figure of merit requirements for the sensor switches, including the minimum acceptable on/off conductivity change and maximum acceptable dielectric loss over RF bands of interest. These figures of merit will also impose limits on sensor sensitivity that will depend on the properties of the switch (i.e., abrupt vs. gradual change in RF conductivity as a function of target analyte concentration and response time).

Candidate switch structures (not necessarily chemically sensitive), include chemoresistive conducting polymers, metal nanowire networks (which need not be a composite), and a-Si switches (for example, for optically excited switches). Candidate materials can be simply evaluated using measurements of the RF transmission of a simple two segment monopole antenna where the two segments are connected (or disconnected) via the candidate switches.

Other Examples

The electromagnetic response of an FSS can be used to detect the presence of one or more of a plurality of external conditions. External conditions which can be detected include the presence of chemical analytes (including pollution, odor, and the like), biological analytes, electromagnetic radiation (such as light, UV, x-rays, IR, radio waves, long-wave electromagnetic radiation), nuclear radiation, sound (such as noise), and ultrasound. An FSS can also be used to monitor weather conditions (such as the presence of moisture, precipitation, humidity and the like), static electricity, temperature, vibration, and the like.

An FSS can be provided with one or more elements, such as switches, having an electrical conductivity correlated with the external condition of interest. For example, a switch could operate if temperature crosses a threshold value. The element may be coupled with other sensing elements. For example, a luminescent ionizing radiation detector can be optically coupled to one or more photosensitive switches within an FSS. An electromagnetic radiation sensor may provide an electrical signal to transistors, or other semiconductor switches, within the FSS. Other examples will be clear to those skilled in the art.

An example FSS may be fabricated using the same surface if each of the switches locations can be addressed individually. However, many applications use external conditions to turn the switches on or off. This includes chemical and biological sensing applications, where the switch elements are fabricated from materials that change their conductivity state in the presence of a particular chemical or biological analyte. In such case, groups of switches typically respond in unison to a particular chemical or biological analyte. Accordingly, where there are shared switches in a FSS, they can be implemented using two different starting surfaces.

There are many uses for this technology, including but not limited to, its application to the development of new remote sensing systems for chemical and/or biological agents. In these systems, the type of switches used in the RFSS are specifically designed to turn on or off upon exposure to a variety of chemical and/or biological agents. Deployed sensors of this type can be interrogated remotely via directed radio frequency, infrared, and visible electromagnetic energy, allowing the frequency response of the reflected or transmitted signals to be correlated with a known set of environmental responses.

Examples discussed above refer to unit cells of frequency selective surfaces. However, example configurations according to the present invention include which non-periodic, non-FSS structures. Configurations can also be provided to load an antenna, for example to change the resonant frequency of the antenna.

Example FSS geometries given herein are exemplary, and many other examples exist. For example, an FSS screen having eight-fold symmetry can be used to obtain polarization independence, if desired. (In the example of a square unit cell, there is symmetry is about axes through the center, parallel to the sides and the two diagonals). In other examples, non-square unit cells can be used.

Examples of the present invention include apparatus and methods for detecting chemical analytes such as pollutants, explosives and indicators thereof, atmospheric gases, fluid components, gaseous emission composition (such as from a chimney or exhaust, biological agents such as pathogens, and the like.

Hence, a frequency selective surface (FSS) can comprise a periodically replicated unit cell supported by a substrate, the unit cell including a chemoresistive material having an electrical conductivity that changes in a presence of an analyte or other external condition. The unit cell can be chosen to provide an electromagnetic resonance, and one or more electromagnetic properties of the FSS determined at the resonance so as to determine the presence or absence of the analyte. For example, the unit cell may comprises an electrically conducting patch (or a dipole slot) and a region of chemoresistive material adjacent to the electrically conducting patch (or dipole slot). The unit cell may comprise a plurality of electrically conducting patches, and at least one region of chemoresistive material. First, second, third, etc. chemoresistive materials can be used, providing electrical conductivities responsive to the presence of first, second, third, etc. (respectively) external conditions, such as analytes.

An apparatus according to an example of the present invention comprises a periodic structure including a pattern of a material responsive to an external condition, and has an electromagnetic property correlated with the presence or absence, or magnitude of, an external condition (such as analyte presence). Changes in the electromagnetic property at least in part arise from an electrical conductivity changes of the material, such as a chemoresistive material, photoconductor, other conducting materials sensitive to one or more external conditions, and the like.

While the invention has been particularly shown and described with reference to preferred embodiments thereof, it will be understood by those skilled in the art that various alterations in form and detail may be made therein without departing from the spirit and scope of the invention.

The invention is not restricted to the illustrative examples described herein. Examples are not intended as limitations on the scope of the invention. Methods, apparatus, compositions, and the like described herein are exemplary and not intended as limitations on the scope of the invention. Changes therein and other uses will occur to those skilled in the art. The scope of the invention is defined by the scope of the claims.

Patents, patent applications, or publications mentioned in this specification are incorporated herein by reference to the same extent as if each individual document was specifically and individually indicated to be incorporated by reference. In particular, U.S. Prov. Pat. App. Ser. No. 60/536,444, filed Jan. 14, 2004, is incorporated herein in its entirety.

We claim:

1. A frequency selective surface (FSS) comprising a periodically replicated unit cell, the unit cell including a chemoresistive material having an electrical conductivity that changes in a presence of an analyte, the unit cell comprising:

a dielectric substrate;

at least one conducting patch on the dielectric substrate; and a chemoresistive switch comprising the chemoresistive material adjacent the conducting patch, the chemoresistive switch having a switch state related to the presence or absence of the analyte, the FSS having an electromagnetic property that is modified by a change in the switch state so as to allow detection of the analyte.

2. The FSS of claim 1, wherein the unit cell further comprises an arrangement of conducting patches on the dielectric substrate, wherein at least two conducting patches are interconnected by the chemoresistive switch comprising the chemoresistive material.

3. The FSS of claim 1, wherein at least two conducting metal patches are interconnected by the switch comprising the chemoresistive material.

4. The FSS of claim 1, wherein the chemoresistive material comprises a conducting polymer.

5. The FSS of claim 4, wherein the electrical conductivity of the conducting polymer decreases when the conducting polymer is exposed to the analyte.

6. The FSS of claim 1, wherein the chemoresistive material includes a semiconductor nanostructure.

7. The FSS of claim 1, wherein the chemoresistive material includes a metal nanostructure.

8. The FSS of claim 1, wherein the chemoresistive material includes a composite of a polymer and electrically conducting particles.

9. The FSS of claim 8, wherein the conducting particles are carbon-containing particles.

10. The FSS of claim 8, wherein the polymer swells on exposure to the analyte.

11. An artificial magnetic conductor comprising the FSS of claim 1, the FSS being supported by a surface of a thin dielectric substrate, the opposed surface of the dielectric layer supporting an electrical conductor.

12. An electromagnetic absorber including the FSS of claim 1.

13. An antenna including the FSS of claim 1.

14. An electromagnetic reflector including the FSS of claim 1.

15. A frequency selective surface (FSS) comprising a periodically replicated unit cell, the unit cell including a chemoresistive material having an electrical conductivity that changes in a presence of an analyte, wherein the unit cell includes at least one dielectric slot in a conducting medium, the chemoresistive material being adjacent to the dielectric slot.

16. A process for detecting an analyte, the process comprising:

providing an apparatus including a frequency selective surface (FSS), the FSS comprising a periodically replicated unit cell, the unit cell comprising a dielectric substrate and a chemoresistive material, the chemoresistive material having an electrical conductivity that changes on exposure to the analyte;

determining an electromagnetic property of the apparatus, the electromagnetic property being correlated with the electrical conductivity of the chemoresistive material; and detecting the analyte using the electromagnetic property.

17. The process of claim 16, wherein the electromagnetic property is an electromagnetic transmission, electromagnetic absorption, or electromagnetic reflection.

18. The process of claim 16, wherein the apparatus has a resonance frequency, and the electromagnetic property is determined at the resonance frequency.

19. The process of claim 16, wherein determining the electromagnetic property includes irradiating the apparatus with electromagnetic radiation from a remote source of electromagnetic radiation.

20. The process of claim 19, wherein the remote source of electromagnetic radiation includes a radar transmitter.

21. The process of claim 16, wherein the apparatus includes a frequency selective surface (FSS) comprising an arrangement of metal patches selectively electrically interconnectable by chemoresistive switches, the chemoresistive switches including the chemoresistive material.

22. The process of claim 16, wherein the FSS has a resonance frequency, the electromagnetic property being detected at the resonance frequency.

23. The process of claim 16, wherein the apparatus is deployed into the atmosphere, and determining the electromagnetic property of the apparatus includes irradiating the apparatus with a radar beam and detecting reflected radar radiation.

24. A frequency selective surface (FSS), the FSS comprising a periodically replicated unit cell, the unit cell including a chemoresistive material having an electrical conductivity that changes in a presence of an analyte, the FSS comprising:

a dielectric substrate;

an arrangement of conducting metal patches on the dielectric substrate; and at least one chemoresistive element comprising the chemoresistive material interconnecting a pair of conducting metal patches.

25. The FSS of claim 24, wherein the unit cell has a geometry chosen so as to provide an electromagnetic resonance at a resonance frequency.

26. The FSS of claim 24, wherein the unit cell comprises an electrically conducting patch and a region of chemoresistive material adjacent to the electrically conducting patch.

27. The FSS of claim 24, wherein the unit cell comprises a plurality of electrically conducting patches, and at least one region of chemoresistive material.

28. The FSS of claim 24, wherein the unit cell comprises a first chemoresistive material having a first electrical conductivity correlated with a presence of a first analyte, and a second chemoresistive material having an electrical conductivity correlated with a presence of a second analyte.

29. A frequency selective surface (FSS), the FSS comprising a periodically replicated unit cell, the unit cell including a chemoresistive material having an electrical conductivity that changes in a presence of an analyte, wherein the unit cell includes at least one dipole slot formed in a metal screen, and a region of chemoresistive material within the metal screen.

30. The FSS of claim 29, wherein the region of chemoresistive material is substantially adjacent to the at least one dipole slot.

31. An apparatus comprising a periodic structure, the periodic structure including a pattern of metal patches and a pattern of chemoresistive material, the apparatus having a first electromagnetic property in a presence of an analyte, and a second electromagnetic property in an absence of the analyte, a difference between the first electromagnetic property and the second electromagnetic property at least in part arising from an electrical conductivity change of the chemoresistive material, the periodic structure being a frequency selective surface (FSS).

32. The apparatus of claim 31, wherein the pattern of metal patches and the pattern of chemoresistive material are supported on a surface of a dielectric layer.

33. The apparatus of 31, wherein the periodic structure comprises a replicated pattern of metal patches selectively interconnected by the chemoresistive material.

34. The apparatus of claim 31, wherein the apparatus is an electromagnetic absorber, electromagnetic reflector, electromagnetic transmitter, or antenna.

35. An apparatus including a frequency selective surface (FSS), the FSS comprising a pattern of conductive patches, the conducting patches being selectively interconnectable by a matrix of independently addressable switches, the switches being passive switches not in electrical communication with a voltage source, the switches being responsive to an analyte, the switches having a first electrical conductivity in a presence of the analyte, and a second electrical conductivity in an absence of the analyte.

36. The apparatus of claim 35, comprising a plurality of switch types, wherein each switch type is responsive to a different analyte.

* * * * *